US010308392B2

(12) United States Patent
Ogawa et al.

(10) Patent No.: US 10,308,392 B2
(45) Date of Patent: Jun. 4, 2019

(54) PACKING BOX

(71) Applicant: Kose Corporation, Tokyo (JP)

(72) Inventors: Shuichi Ogawa, Saitama (JP); Akira Takase, Saitama (JP); Fumiko Noda, Saitama (JP); Megumi Imai, Tokyo (JP); Takuji Kobayashi, Tokyo (JP); Yumiko Yakuden, Tokyo (JP)

(73) Assignee: Kose Corporation, Tokyo (JP)

( * ) Notice: Subject to any disclaimer, the term of this patent is extended or adjusted under 35 U.S.C. 154(b) by 0 days.

(21) Appl. No.: 15/307,387

(22) PCT Filed: Apr. 28, 2015

(86) PCT No.: PCT/JP2015/062885
§ 371 (c)(1),
(2) Date: Oct. 28, 2016

(87) PCT Pub. No.: WO2015/166964
PCT Pub. Date: Nov. 5, 2015

(65) Prior Publication Data

US 2017/0043901 A1 Feb. 16, 2017

(30) Foreign Application Priority Data

Apr. 30, 2014 (JP) ..... 2014-093636
Jun. 25, 2014 (JP) ..... 2014-129844

(51) Int. Cl.
*B65D 5/66* (2006.01)
*B65D 5/42* (2006.01)
(Continued)

(52) U.S. Cl.
CPC ..... *B65D 5/6655* (2013.01); *B65D 5/008* (2013.01); *B65D 5/0254* (2013.01);
(Continued)

(58) Field of Classification Search
CPC ..... B65D 5/6655; B65D 5/54; B65D 5/4266; B65D 5/008; B65D 5/0254;
(Continued)

(56) References Cited

U.S. PATENT DOCUMENTS 2,313,987 A 3/1941 Buttery
2,986,323 A 5/1961 Wichman
(Continued)

FOREIGN PATENT DOCUMENTS

CN 2771112 Y 4/2006
CN 201102725 Y 8/2008
(Continued)

*Primary Examiner* — Christopher R Demeree
(74) *Attorney, Agent, or Firm* — Howson & Howson LLP

(57) ABSTRACT

Problem to be Solved
Provided is a packing box that enables to easily release a slit lock in which slits of an insertion piece of an openable lid engage with side flaps connected to openable lid side edge portions of lid side members, even if the interior of a box body of the packing box is tightly filled with a product.
Solution
The top face lid (540) of the packing box (500) includes a part that can be torn along the tear inducing line (543) extending from the flap opposing edge (541) of the top face lid to the front end edge (542) of the top face lid (540), and the part is held and torn along the tear inducing line (543) by a human hand and is raised up with respect to the top face lid (540) to form the slit lock release gripping piece (544) that can be used for releasing engagement created by the slit lock engaging structure (LK), so that the engagement by the slit lock engaging structure (LK), which is the engagement between the insertion piece (550) and the side flap (530) in the slit (SL22) on the side in the lateral direction of the insertion piece (550) where the slit lock release gripping
(Continued)

piece (544) is formed, can be easily released even if the interior of the box body of the packing box is tightly filled.

7 Claims, 26 Drawing Sheets

(51) Int. Cl.
*B65D 5/00* (2006.01)
*B65D 5/54* (2006.01)
*B65D 5/02* (2006.01)

(52) U.S. Cl.
CPC ..... *B65D 5/4266* (2013.01); *B65D 5/54* (2013.01); *B65D 5/5415* (2013.01); *B65D 5/5455* (2013.01); *B65D 2101/0023* (2013.01)

(58) Field of Classification Search
CPC ..... B65D 2101/0023; B65D 2101/00; B65D 5/541; B65D 5/6608; B65D 5/701
USPC ..... 229/102, 148, 151, 153; 206/807
See application file for complete search history.

(56) References Cited

U.S. PATENT DOCUMENTS

| | | | | |
|---|---|---|---|---|
| 4,802,590 | A * | 2/1989 | Smith | B65D 5/741 229/218 |
| 5,082,117 | A * | 1/1992 | Zimmermann | B65D 5/742 229/218 |
| 5,711,479 | A * | 1/1998 | Spronk | B65D 5/0272 229/121 |
| 2006/0124708 | A1 | 6/2006 | Lo Duca | |

FOREIGN PATENT DOCUMENTS

| | | | |
|---|---|---|---|
| CN | 202508375 | U | 10/2012 |
| EP | 1820740 | A1 | 8/2006 |
| EP | 2112077 | A1 | 10/2009 |
| JP | S48-112743 | U | 12/1973 |
| JP | 53-33716 | | 8/1978 |
| JP | S5333716 | A1 | 8/1978 |
| JP | 10-77029 | A | 3/1998 |
| JP | 2001-301741 | A | 10/2001 |
| JP | 2002-19766 | A | 1/2002 |
| JP | 2007-209598 | A | 8/2007 |
| JP | 2007-253966 | A | 10/2007 |
| JP | 2013-1424 | A | 1/2013 |
| JP | 2013230855 | A | 11/2013 |
| JP | 2014-108819 | A | 6/2014 |

* cited by examiner

PACKING BOX

FIELD OF THE INVENTION

The present invention relates to a packing box forming a slit lock engaging structure for retaining a state in which an openable lid is closed by engaging a portion of a side flap into a slit created by partially cutting a connection base end of an insertion piece along a folding line. Particularly, the present invention relates to a packing box that packs a product itself, such as a cosmetic, drug, food, or toy, or a fancy box that houses the product and is displayed on a sales floor, such as a store front, for protecting the product or the fancy box from being damaged or impacted during delivery of the product or the fancy box to the sales floor.

BACKGROUND OF THE INVENTION

As one example of the packing box, a packing case is conventionally known that includes an arc-like cutout portion formed at an upper end of a front face of box body overlapping an insertion piece and a push-in piece formed at a portion of the box body facing the cutout portion and surrounded with an arc-like cut so that a finger hook hole can be created, wherein the packing case is opened by hooking a finger into the finger hooking hole and pulling up a lid portion (see Patent Literature 1, for example).

As another example of the packing box, an article storage box is known that includes cut lines (slits) provided at both ends of a border between a lid plate and an insertion piece and side flaps, wherein the article storage has a so-called slit lock structure in which the side flaps are hooked into the cut lines (slits) (see Patent Literatures 2 and 3, for example).

As another example of the packing box, a sealed box is known that includes locking cuts formed at both end portions of a lateral folding line between a top face flap piece and a top face insertion flap piece and constituting a lock mechanism, locking projection pieces formed at base ends of inner top face flap pieces and constituting the lock mechanism, and a flange formed at a center portion of the top face flap piece and used as a start portion of tearing along tear inducing lines (see Patent Literature 4, for example).

In a state in which the top face flap piece closes an opening of a tubular body, the top face insertion flap piece is anchored by inserting locking projection pieces into the locking cuts so that the state in which the top face flap piece closes the opening is maintained. An article stored in the sealed box can be taken out by tearing along the tear inducing lines.

As another example of the packing box, a paper box is known that locks a lid plate in a closed state by engaging base portions at both ends of an insertion piece to front edge portions of lid pieces (side flaps) (see Patent Literature 5, for example). The paper box is opened by pushing a push-in portion, which is formed at a front portion of the lid plate with a folding line or a cut line, by a finger to create a depressed area and then inserting the finger into the depressed area to lift up the lid plate by the finger to unlock the lid plate.

CITATION LIST

Patent Literature

[Patent Literature 1] Japanese Patent Application Laid-Open No. 2007-253966 (particularly, see FIGS. 1 to 3)

[Patent Literature 2] Japanese Patent Application Laid-Open No. 2001-301741 (particularly, see FIG. 1)

[Patent Literature 3] Japanese Patent Application Laid-Open No. 2007-209598 (particularly, see FIGS. 1 and 2)

[Patent Literature 4] Japanese Patent Application Laid-Open No. 2013-1424 (particularly, see FIGS. 1 to 3)

[Patent Literature 5] Japanese Patent Application Laid-Open No. 2002-19766 (particularly, see FIGS. 1 to 10)

[Patent Literature 6] Japanese Patent Application Laid-Open No. H10-77029 (particularly, see FIGS. 2 to 4)

SUMMARY OF THE INVENTION

Technical Problem

However, because the conventional packing case of Patent Literature 1 has a structure in which the finger hook hole is created by pushing the push-in piece into the interior of the box body, the finger hook hole cannot be created for opening the lid portion when the interior of the box body is tightly filled with a fancy box or the like.

Also, because the conventional article storage box described in Patent Literatures 2 and 3 has the structure in which the lid plate is opened by inserting a finger between the front plate and the insertion piece for deflecting the insertion piece to unhook the side flaps from the cut lines (slits), it is difficult to open the lid plate to take a fancy box or the like out of the article storage box when the interior of box body is tightly filled with the fancy box or the like so that a finger cannot be inserted between the front plate and the insertion piece for deflecting the insertion piece.

Also, because the sealed box described in Patent Literature 4 has the structure in which a part of the top face flap piece is opened by tearing from the flange without unlocking the lock mechanism, it is difficult to take a fancy box or the like out of the sealed box when the interior of box body is tightly filled with the fancy box or the like, since the fancy box or the like gets caught on the rest of the top face flap piece.

Also, because the paper box described in Patent Literature 5 has the structure in which the push-in portion is pushed by a finger for opening the lid plate, it is difficult to take a fancy box or the like out of the paper box when the interior of box body is tightly filled with the fancy box or the like, since the push-in portion cannot be pushed by a finger in the first place.

Meanwhile, a suspended packing box is known that includes a suspension piece having a suspension hole formed with a separation line, such as a perforation line or a tear line, which extends from one side edge of an upper lid to a back face side of the upper lid (see Patent Literature 6, for example). However, the separation line is provided for simply forming a part of the upper lid as the suspension piece and has nothing to do with opening the upper lid.

Thus, the object of the present invention, which has been achieved for addressing the above described problems, is to provide a packing box that can easily release a slit lock in which slits of an insertion piece of an openable lid engage with side flaps connected to openable lid side edge portions of lid side members, even if the interior of a box body of the packing box is tightly filled with a product.

Solution to Problem

According to a first aspect of the present invention, the above-describes problems are addressed by providing a packing box including an openable lid that constitutes at least one face of a box body, which is a polyhedron to house a product, and openably and closably swings around a base end to seal a product taking-in/out opening formed at a position of the one face, a side flap that is laterally located with respect to the openable lid and is connected via a folding line to an openable lid side edge portion of a lid side member constituting a part of the polyhedron for preventing protrusion of the product, and an insertion piece that is connected to a front end edge of the openable lid via a folding line and is inserted into the box body for holding the openable lid, the packing box constituting a slit lock engaging structure that maintains a state in which the openable lid is closed by engaging a part of the side flap into a slit created by cutting a part of a connection base end of the insertion piece along the folding line, wherein the openable lid includes a part that can be torn along a tear inducing line extending from a flap opposing edge of the openable lid opposing the side flap to a front end edge of the openable lid, and the part is held and torn along the tear inducing line by a human hand and is raised up with respect to the openable lid to form a slit lock release gripping piece that can be used for releasing engagement created by the slit lock engaging structure.

According to a second aspect of the present invention, the above-describes problems are further addressed by providing the packing box according to the first aspect, wherein the slit includes a L-shaped cut formed by cutting from a start point on a folding line, which is a border between the insertion piece and the openable lid, toward a side of the insertion piece for a length that is at least equal to a thickness of the side flap and then cutting toward a side end of the insertion piece, and the insertion piece is folded with respect to the openable lid for forming the slit, and a part of the openable lid projecting forward from the folding line when the insertion piece is folded with respect to the openable lid forms an unlock projection piece that is able to abut against the side flap in the slit when the slit lock release gripping piece is raised up to release the engagement created by the slit lock engaging structure.

According to a third aspect of the present invention, the above-describes problems are further addressed by providing the packing box according to the first or second aspect, wherein the tear inducing line is formed in an arc-like shape that is orthogonal to the flap opposing edge and the front end edge of the openable lid.

According to a fourth aspect of the present invention, the above-describes problems are further addressed by providing the packing box according to the third aspect, wherein the arc-like shape of the tear inducing line is an arc of a precise circle whose center is located at a cross-point of the front end edge and the flap opposing edge of the openable lid.

According to a fifth aspect of the present invention, the above-describes problems are further addressed by providing the packing box according to the third aspect, wherein an open window is formed on any one face of the polyhedron.

According to a sixth aspect of the present invention, the above-describes problems are further addressed by providing the packing box according to the third aspect, wherein at least one of the slit lock release gripping piece and the side flap has a temporary gluing portion on a face thereof opposing the other of the slit lock release gripping piece and the side flap, the temporary gluing portion including a glue applied thereto for gluing to, removing from, and regluing to the other of the slit lock release gripping piece and the side flap.

According to a seventh aspect of the present invention, the above-describes problems are further addressed by providing the packing box according to the third aspect, wherein a cutout portion is provided in an upper end portion of a front wall plate member constituting at least one face of the box body so as to oppose the tear inducing line at the front end edge of the openable lid.

Advantageous Effects of Invention

Because the packing box of the present invention includes an openable lid that constitutes at least one face of a box body, which is a polyhedron to house a product, and openably and closably swings around a base end to seal a product taking-in/out opening formed at a position of the one face, a side flap that is laterally located with respect to the openable lid and is connected via a folding line to an openable lid side edge portion of a lid side member constituting apart of the polyhedron for preventing protrusion of the product, and an insertion piece that is connected to a front end edge of the openable lid via a folding line and is inserted into the box body for holding the openable lid, the packing box constituting a slit lock engaging structure that maintains a state in which the openable lid is closed by engaging a part of the side flap into a slit created by cutting a part of a connection base end of the insertion piece along the folding line, the packing box not only prevents the openable lid from being opened accidentally but also has the following unique effects.

According to the packing box of the first aspect of the present invention, because the openable lid includes apart that can be torn along a tear inducing line extending from a flap opposing edge of the openable lid opposing the side flap to a front end edge of the openable lid, and the part is held and torn along the tear inducing line by a human hand and is raised up with respect to the openable lid to form a slit lock release gripping piece that can be used for releasing engagement created by the slit lock engaging structure, the slit lock release gripping piece is torn from the flap opposing edge of the openable lid along the tear inducing line and is raised up due to a pulling force in upward and forward directions created by a human hand when the openable lid is opened, the upward direction being the direction in which the openable lid opens, and the insertion piece is also pulled upward and forward as the slit lock release gripping piece is pulled upward and forward by a human hand so that the slit at a side of the insertion piece in a lateral direction of the insertion piece where the slit lock release gripping piece is formed moves forward with respect to the side flap, allowing the side flap to be taken out of the slit and the slit to move in the upward direction. Thus, the engagement by the slit lock engaging structure, which is the engagement between the insertion piece and the side flap in the slit on the side in the lateral direction of the insertion piece where the slit lock release gripping piece is formed, can be easily released even if the interior of the box body of the packing box is tightly filled.

According to the packing box of the second aspect of the present invention, because the slit includes a L-shaped cut formed by cutting from a start point on a folding line, which is a border between the insertion piece and the openable lid, toward a side of the insertion piece for a length that is at least equal to a thickness of the side flap and then cutting toward a side end of the insertion piece, and the insertion piece is folded with respect to the openable lid for forming the slit, and a part of the openable lid projecting forward from the folding line when the insertion piece is folded with respect to the openable lid forms an unlock projection piece that is able to abut against the side flap in the slit when the slit lock release gripping piece 111*e* is raised up to release the engagement created by the slit lock engaging structure, the unlock projection piece swings around the folding line to push the side flap out of the slit when the slit lock release gripping piece is raised up. Thus, the engagement by the slit lock engaging structure, which is the engagement between the insertion piece and the side flap in the slit on the side in the lateral direction of the insertion piece where the slit lock release gripping piece is formed, can be reliably released.

According to the packing box of the third aspect of the present invention, because the tear inducing line is formed in an arc-like shape that is orthogonal to the flap opposing edge and the front end edge of the openable lid, the direction of a stress acting on the tear inducing line gradually changes from the direction orthogonal to the flap opposing edge of the openable lid to the direction orthogonal to the front end edge of the openable lid when a part of the openable lid is raised up from the flap opposing edge by a human hand, and the point on which the stress acts does not stay on a single location on the tear inducing line but moves gradually from the flap opposing edge to the front end edge of the openable lid in an arc-like manner. Thus, the slit lock release gripping piece can be formed by tearing along the tear inducing line smoothly.

According to the packing box of the fourth aspect of the present invention, because the arc-like shape of the tear inducing line is an arc of a precise circle whose center is located at a cross-point of the front end edge and the flap opposing edge of the openable lid, the amount of the stress acting along the tear inducing line is substantially equalized in accordance with the radius of the precise circle and a load acting from a human hand is also substantially equalized when a part of the openable lid is raised up from the flap opposing edge of the openable lid by a human hand. Thus, the slit lock release gripping piece can be formed by tearing along the tear inducing line more smoothly.

According to the packing box of the fifth aspect of the present invention, because an open window is formed on any one face of the polyhedron, a product housed in the packing box can be seen from outside through the open window. Thus, a user can check the product. Also, the bar code of product information written on the product housed in the packing box can be seen from outside through the open window. Thus, a person in charge of product inspection, for example, can inspect the product.

According to the packing box of the sixth aspect of the present invention, because at least one of the slit lock release gripping piece and the side flap has a temporary gluing portion on a face thereof opposing the other of the slit lock release gripping piece and the side flap, the temporary gluing portion including a glue applied thereto for gluing to, removing from, and regluing to the other of the slit lock release gripping piece and the side flap, the slit lock release gripping piece is temporarily glued in a position that is in the same plane as the openable lid. Thus, the slit lock release gripping piece can be returned to the position that is in the same plane as the openable lid even after the packing box is opened for continuously using the packing box, and the slit lock can be re-released as need arises.

According to the packing box of the seventh aspect of the present invention, because a cutout portion is provided in an upper end portion of a front wall plate member constituting at least one face of the box body so as to oppose the tear inducing line at the front end edge of the openable lid, a portion of the front wall plate member near the slit lock release gripping piece can easily deflect forward and the insertion piece can be easily displaced forward when the slit lock release gripping piece is pulled upward and forward by the pulling force. Thus, the engagement by the slit lock engaging structure on the side in the lateral direction of the insertion piece where the slit lock release gripping piece is formed can be released more easily.

Also, because the cutout portion is provided in the upper end portion of the front wall plate member constituting at least one face of the box body so as to oppose the tear inducing line at the front end edge of the openable lid, stress acting on an end point of the tear inducing line, which is a joint portion between the slit lock release gripping piece and the insertion piece, is dispersed when the slit lock release gripping piece is pulled upward and forward by the pulling force. Thus, a break that tends to occur at this point can be suppressed to more reliably release the engagement between the insertion piece and the side flap in the slit created by the slit lock engaging structure.

BRIEF DESCRIPTION OF THE DRAWINGS

FIG. 3A is a rear perspective view illustrating the behavior of the slit lock release gripping piece of the present invention.

FIG. 13 is a development view of the packing box of the fourth embodiment of the present invention.

DETAILED DESCRIPTION

Figure 1:
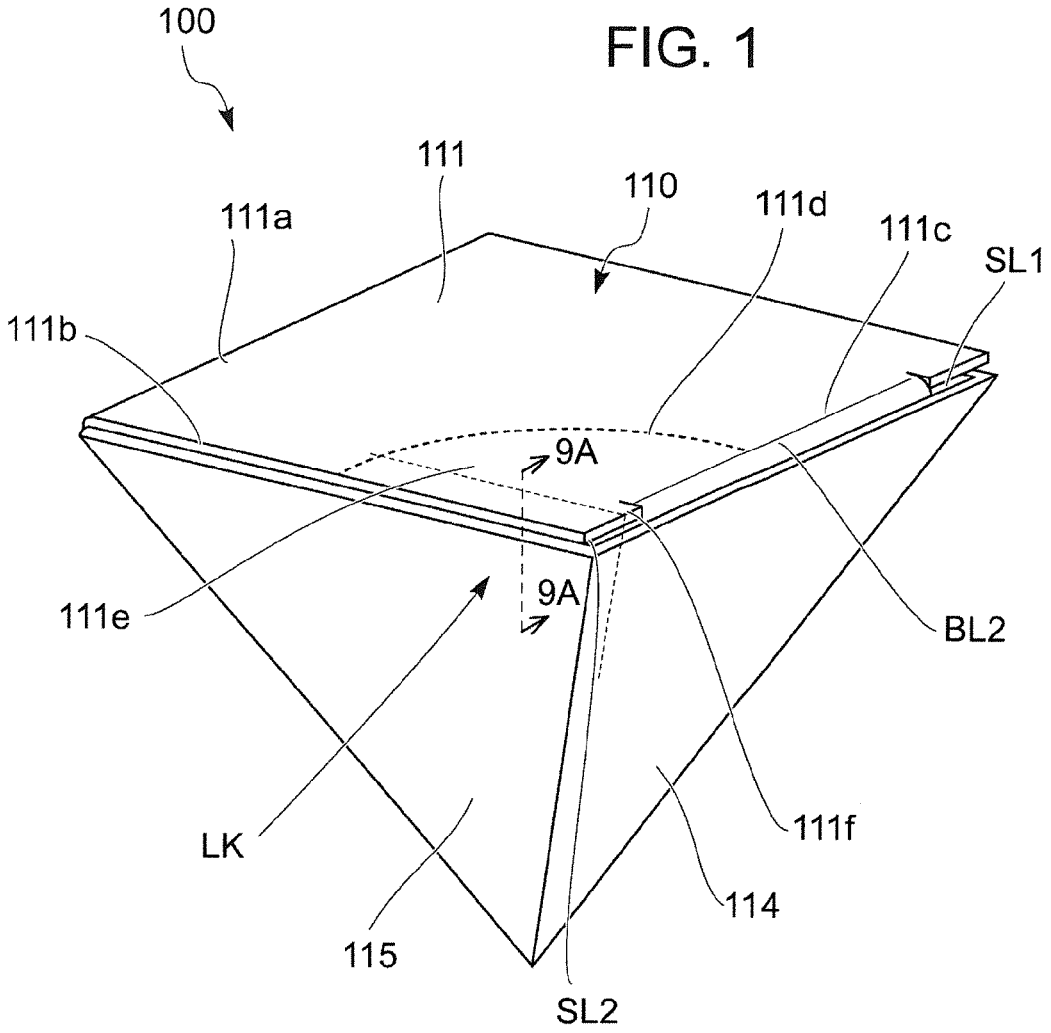
FIG. 1 is a front perspective view schematically illustrating the packing box of a first embodiment of the present invention.

Details of embodiments of the present invention do not matter as long as the packing box provided by the present invention includes an openable lid that constitutes at least one face of a box body, which is a polyhedron to house a product, and openably and closably swings around a base end to seal a product taking-in/out opening formed at a position of the one face, a side flap that is laterally located with respect to the openable lid and is connected via a folding line to an openable lid side edge portion of a lid side member constituting a part of the polyhedron for preventing protrusion of the product, and an insertion piece that is connected to a front end edge of the openable lid via a folding line and is inserted into the box body for holding the openable lid, the packing box constituting a slit lock engaging structure that maintains a state in which the openable lid is closed by engaging a part of the side flap into a slit created by cutting a part of a connection base end of the insertion piece along the folding line, wherein the openable lid includes a part that can be torn along a tear inducing line extending from a flap opposing edge of the openable lid opposing the side flap to a front end edge of the openable lid, and the part is held and torn along the tear inducing line by a human hand and is raised up with respect to the openable lid to form a slit lock release gripping piece that can be used for releasing engagement created by the slit lock engaging structure, so that the engagement by the slit lock engaging structure, which is the engagement between the insertion piece and the side flap in the slit on the side in the lateral direction of the insertion piece where the slit lock release gripping piece is formed, can be easily released even if the interior of the box body of the packing box is tightly filled.

For example, the packing box may have a shape of a polyhedron such as cube, cuboid, polygonal prism such as hexagonal prism, deltahedron, Platonic solid, or Archimedean solid, and faces of the polyhedron may include one or more types of shapes or sizes, as long as the packing box has the slit lock engaging structure in which a part of a side flap engages into a slit of an insertion piece connected to a front end side of an openable lid, and at least one face of the polyhedron constitutes the openable lid.

The openable lid may be plural. Also, the openable lid may be consist of a single face of the polyhedron, or may be consist of adjacent multiple faces of the polyhedron.

The slit may be a slit that is created with a simple partial cut line, and a slit that is created so as to have a certain amount of width, as with a cutout.

Also, the material of the packing box may be a paper, such as a coated paper, a cardboard, or a coated cardboard, or a resin such as a plastic, as long as the material has enough flexibility for forming a polyhedron.

Also, the tear inducing line may be straight or arc-like, as long as the tear inducing line extends from the flap opposing edge of the openable lid to the front end edge of the openable lid.

Also, the tear inducing line may be a perforated line or a cut line, which is created by making small cuts along a desired line in predetermined intervals for easy tearing, or may be created by making the portion of the desired line thinner than the other portions so that tearing along the desired line can be easily executed.

First Embodiment

A packing box 100 of a first embodiment of the present invention will now be described with reference to FIGS. 1 to 9.

Figure 2:
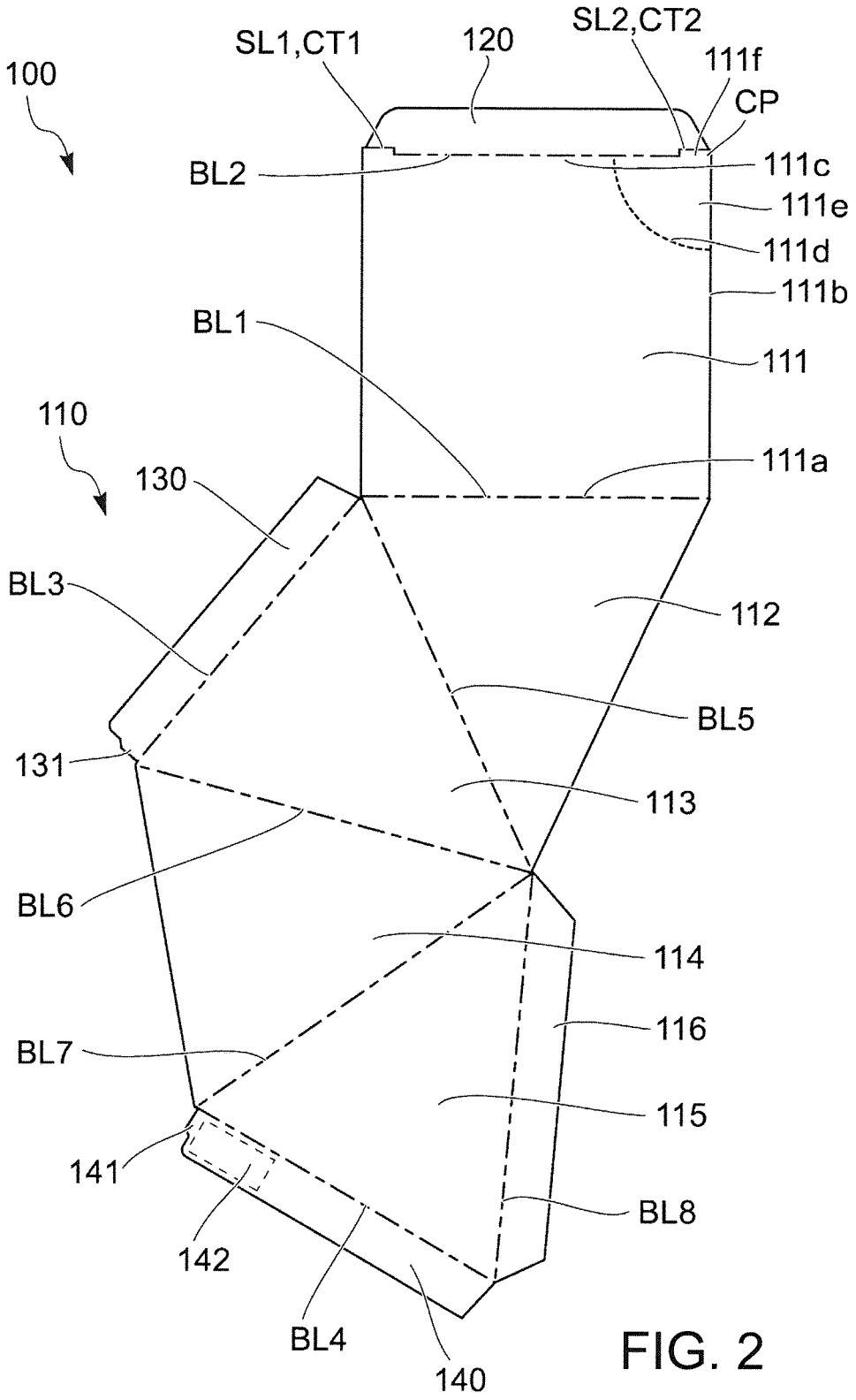
FIG. 2 is a development view of the packing box of the first embodiment of the present invention.
Figure 8:
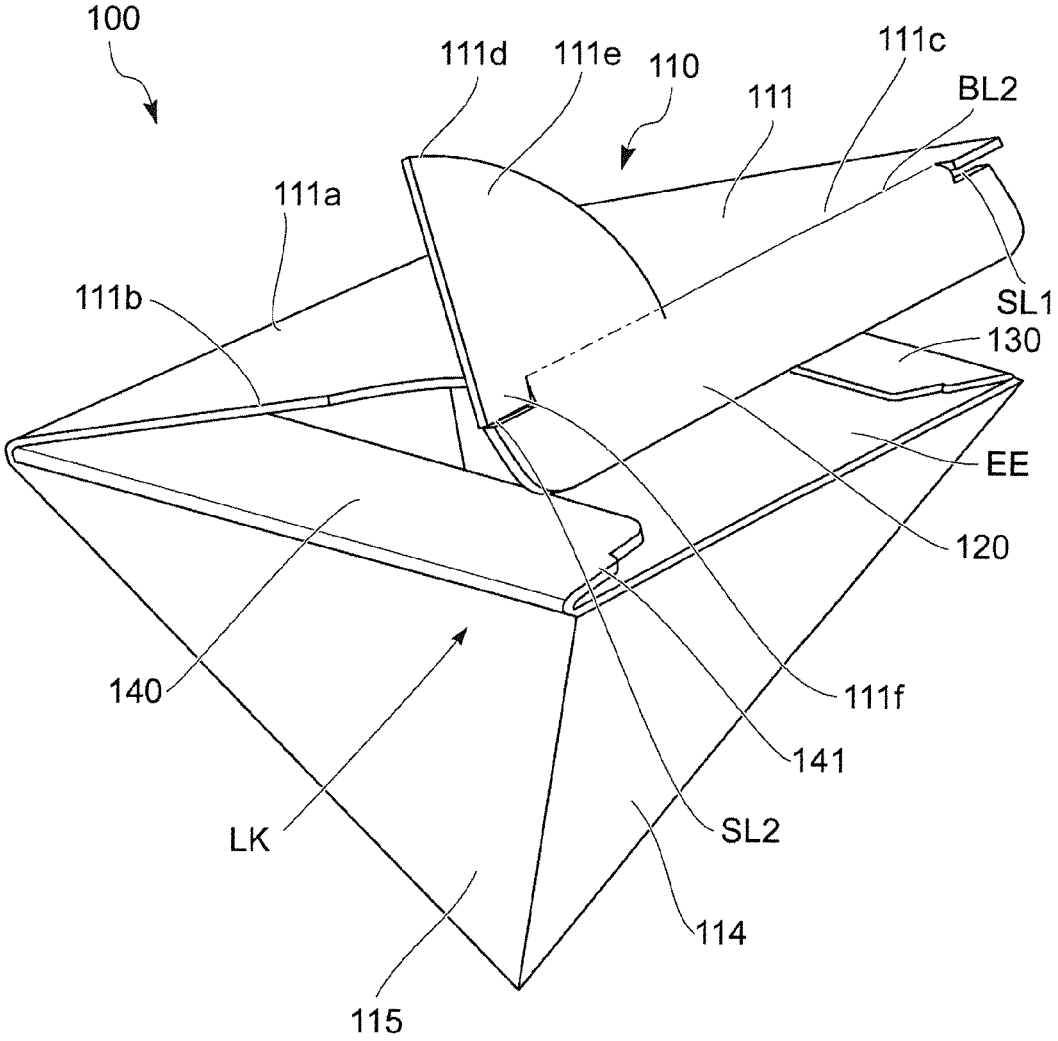
FIG. 8 is a front perspective view illustrating the state in which the openable lid of the packing box of the present invention is open.
Figure 9A:
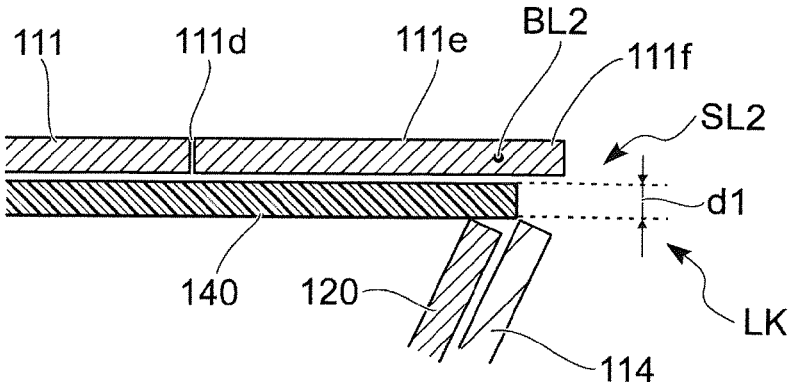
FIG. 9A is a sectional side view as seen in the direction indicated with reference numerals 9A-9A in FIG. 1.
Figure 9B:
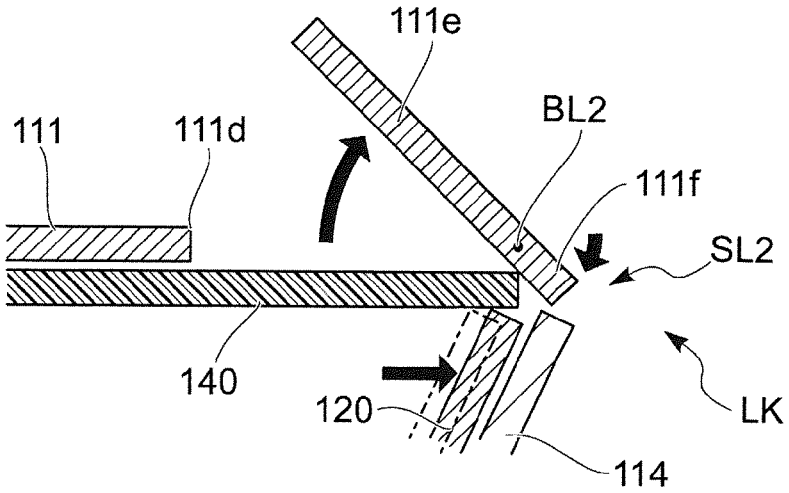
FIG. 9B is a sectional side view as seen in the direction indicated with reference numerals 9B-9B in FIG. 3A.
Figure 9C:
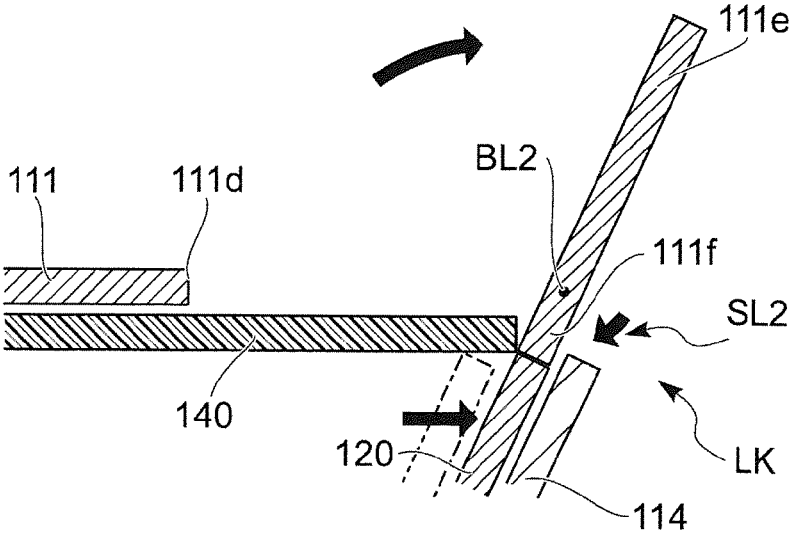
FIG. 9C is a sectional side view as seen in the direction indicated with reference numerals 9C-9C in FIG. 5A.

FIG. 1 is a front perspective view schematically illustrating the packing box 100 of first embodiment of the present invention. FIG. 2 is a development view of the packing box 100 of the first embodiment of the present invention. FIGS. 3A, 4A, 5A, 6A, and 7A are front perspective views illustrating the behavior of a slit lock release gripping piece 111*e* of the present invention. FIGS. 3B, 4B, 5B, 6B, and 7B are rear perspective view respectively corresponding to FIGS. 3A, 4A, 5A, 6A, and 7A. FIG. 8 is a front perspective view illustrating a state in which an openable lid 111 of the packing box 100 of the present invention is open. FIG. 9A is a sectional side view as seen in the direction represented with reference numerals 9A-9A in FIG. 1. FIG. 9B is a sectional side view as seen in the direction represented with reference numerals 9B-9B in FIG. 3A. FIG. 9C is a sectional side view as seen in the direction represented with reference numerals 9C-9C in FIG. 5A.

As illustrated in FIGS. 1 and 2, the packing box 100 of the first embodiment of the present invention is made of a thick coated cardboard, and includes a box body 110 that is an inverted quadrangular pyramid (pentahedron) as one example of a polyhedron having the openable lid 111 and being capable of housing a fancy box (not shown) as one example of a product, an insertion piece 120 that holds the openable lid 111, and left and right side flaps 130 and 140 as side flaps.

The openable lid 111 constitutes one face of the box body 110 that is an inverted quadrangular pyramid, and is provided so as to openably and closably swing around an openable base end folding ruled line BL1, which is a folding line, at a base end 111*a* to seal a product taking-in/out opening EE (see FIG. 8) formed at a position of the one face. The insertion piece 120 is mutually connected to a front end edge 111*c* of the openable lid 111 via an openable front end edge folding ruled line BL2, which is a folding line, and is provided so as to be inserted into the box body 110 to hold the openable lid 111.

The left side flap 130 is configured so as to mutually connect to a left side wall plate member 113, which is a lid side member located at a side with respect to the openable lid 111 and constitutes a part of the inverted quadrangular pyramid, via a left side wall upper end folding ruled line BL3, which is a folding line, at an openable lid side edge portion of the left side wall plate member 113 to prevent protrusion of the product. Similar to the left side flap 130, the right side flap 140 is configured so as to mutually connect to a right side wall plate member 115, which is a lid side member located at a side with respect to the openable lid 111 and constitutes a part of the inverted quadrangular pyramid, via a right side wall upper end folding ruled line BL4, which is a folding line, at an openable lid side edge portion of the right side wall plate member 115 to prevent protrusion of the product.

In the description of the present embodiment, for the purpose of illustration, the upside of the packing box 100 is where the openable lid 111 is located, the front side of the packing box 100 is where a front end edge 111*c*, which is a free end of the openable lid 111, is located, and the rear side of the packing box 100 is where the base end 111*a* is located. Also, "left" and "right" are defined with respect to the packing box 100 that has been constructed. In other words, "left" and "right" are left and right of the packing box 100 as seen from a rear wall plate member 112 toward a front wall plate member 114 of the packing box 100.

As illustrated in FIG. 2, the box body 110 having a shape of an inverted quadrangular pyramid includes the openable lid 111, the rear wall plate member 112, the left side wall plate member 113 as a lid side member, the front wall plate member 114, the right side wall plate member 115 as a lid side member, and a right side rear margin 116. The rear wall plate member 112 is connected to the base end 111*a* of the openable lid 111 via the openable base end folding ruled line BL1, which is a folding line. The left side wall plate member 113 is connected to a left end portion of the rear wall plate member 112 via a rear wall left end folding ruled line BL5, which is a folding line.

The front wall plate member 114 is connected to a front end of the left side wall plate member 113 via a left side wall front end folding ruled line BL6, which is a folding line. The right side wall plate member 115 is connected to a right end portion of the front wall plate member 114 via a front wall right end folding ruled line BL7, which is a folding line. The right side rear margin 116 is connected to a rear end portion of the right side wall plate member 115 via a right side wall rear end folding ruled line BL8, which is a folding line.

When the packing box 100 is constructed, the rear wall plate member 112 or the left side wall plate member 113 is folded along the rear wall left end folding ruled line BL5 so that an angle therebetween becomes 90 degrees, and the left side wall plate member 113 or the front wall plate member 114 is folded along the left side wall front end folding ruled line BL6 so that an angle therebetween becomes 90 degrees. Similarly, the front wall plate member 114 or the right side wall plate member 115 is folded along the front wall right end folding ruled line BL7 so that an angle therebetween becomes 90 degrees, and the right side wall plate member 115 or the right side rear margin 116 is folded along the right side wall rear end folding ruled line BL5 so that an angle therebetween becomes 90 degrees.

Then, the right side rear margin 116 is glued to an inner face of a right end portion of the rear wall plate member 112 with a glue, for example, to form side faces of the inverted quadrangular pyramid of the box body 110. Also, the left side flap 130 is folded rightward, or inward, along the left side wall upper end folding ruled line BL3, and the right side flap 140 is similarly folded leftward, or inward, along the right side wall upper end folding ruled line BL4. The openable lid 111 is folded forward, or inward, along the openable base end folding ruled line BL1, and the insertion piece 120 is folded downward, or inward, along the openable front end edge folding ruled line BL2.

The packing box 100 has a slit lock engaging structure LK in which the openable lid 111 is maintained in a closed state by engaging a part of the side flap into a slit created by partially cutting a connection base end of the insertion piece 120 along the openable front end edge folding ruled line BL2. Specifically, a left L-shaped cut CT1 and a right L-shaped cut CT2 exist in the vicinity of the openable front end edge folding ruled line BL2 of the insertion piece 120. By folding the insertion piece 120 along the openable front end edge folding ruled line BL2 toward the openable lid 111, a left slit SL1 and a right slit SL2, which are gaps between the insertion piece 120 and the openable lid 111, are formed. In the present embodiment, due to a relatively large thickness of the material of the packing box 100, the slits (SL1 and SL2) are formed with the L-shaped cuts (CT1 and CT2). If the thickness of the material of the packing box 100 is relatively small, however, the slits may be formed with simple straight cuts, or I-shaped cuts.

A left slit engaging piece 131 formed at a front end of the left side flap 130 then enters into the left slit SL1, making the insertion piece 120 being engaged by the left slit engaging piece 131 in the left slit SL1. Similarly, a right slit engaging piece 141 formed at a front end of the right side flap 140 enters into the right slit SL2, making the insertion piece 120 being engaged by the right slit engaging piece 141 in the right slit SL2.

In the present embodiment, a tear inducing line 111*d*, which is a perforated line as one example, extends from a right flap opposing edge 111*b*, which is a flap opposing edge of the openable lid 111 opposing the side flap, to a front end edge 111*c* of the openable lid 111. A part of the openable lid 111 is torn along the tear inducing line 111*d* and is raised up with respect to the openable lid 111 by a human hand to form a slit lock release gripping piece 111*e* that can be used for releasing the engagement by the slit lock engaging structure LK.

Figure 3A:
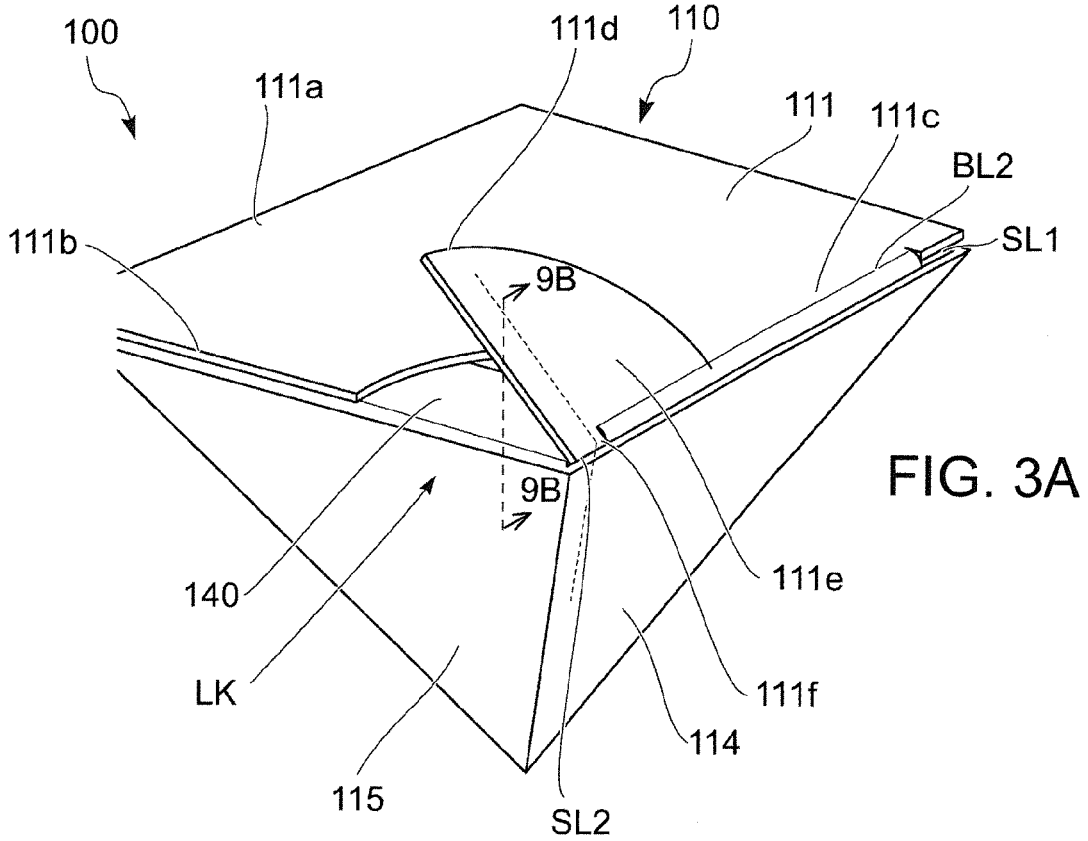
FIG. 3A is a front perspective view illustrating the behavior of the slit lock release gripping piece of the present invention.
Figure 3B:
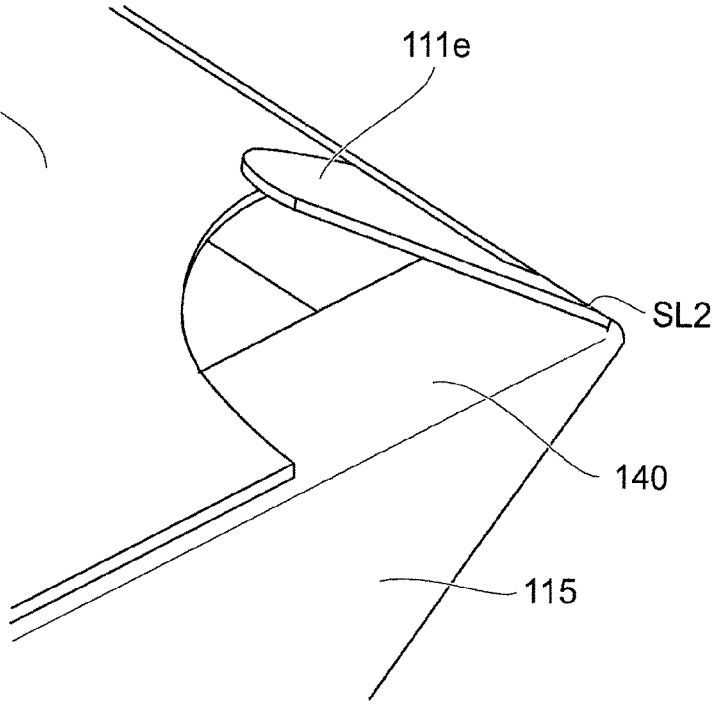

Behavior and function of the slit lock release gripping piece 111*e* will now be described. As illustrated in FIGS. 3A and 3B, when the openable lid 111 is opened from the state illustrated in FIG. 1, a part of the openable lid 111 is torn from the right flap opposing edge 111*b* of the openable lid 111 along the tear inducing line 111*d* due to a pulling force in upward and forward directions created by a human hand and forms the slit lock release gripping piece 111*e*. At this moment, the slit lock release gripping piece 111*e* takes a slightly raised position with respect to the rest of the openable lid 111.

In the present embodiment, the tear inducing line 111*d* is formed in an arc-like shape that is orthogonal to the right flap opposing edge 111*b* and the front end edge 111*c* of the openable lid 111. Thus, when a part of the openable lid 111 is raised up from the right flap opposing edge 111*b* by a human hand, the direction of a stress acting on the tear inducing line 111*d* gradually changes from the direction orthogonal to the right flap opposing edge 111*b* of the openable lid 111 to the direction orthogonal to the front end edge 111*c* of the openable lid 111. Also, the point on which the stress acts does not stay on a single location on the tear inducing line 111*d* but moves gradually from the right flap opposing edge 111*b* to the front end edge 111*c* of the openable lid 111 in an arc-like manner. That is, the tearing along the tear inducing line 111*d* is executed smoothly.

Also, the arc-like shape of the tear inducing line 111*d* is an arc of a precise circle whose center is located at a cross-point CP of the front end edge 111*c* and the right flap opposing edge 111*b* of the openable lid 111. Thus, when apart of the openable lid 111 is raised up from the right flap opposing edge 111*b* of the openable lid 111 by a human hand, the amount of the stress acting along the tear inducing line 111*d* is substantially equalized in accordance with the radius of the precise circle and a load acting from a human hand is also substantially homogenized. That is, the tearing along the tear inducing line 111*d* is executed more smoothly.

Figure 4A:
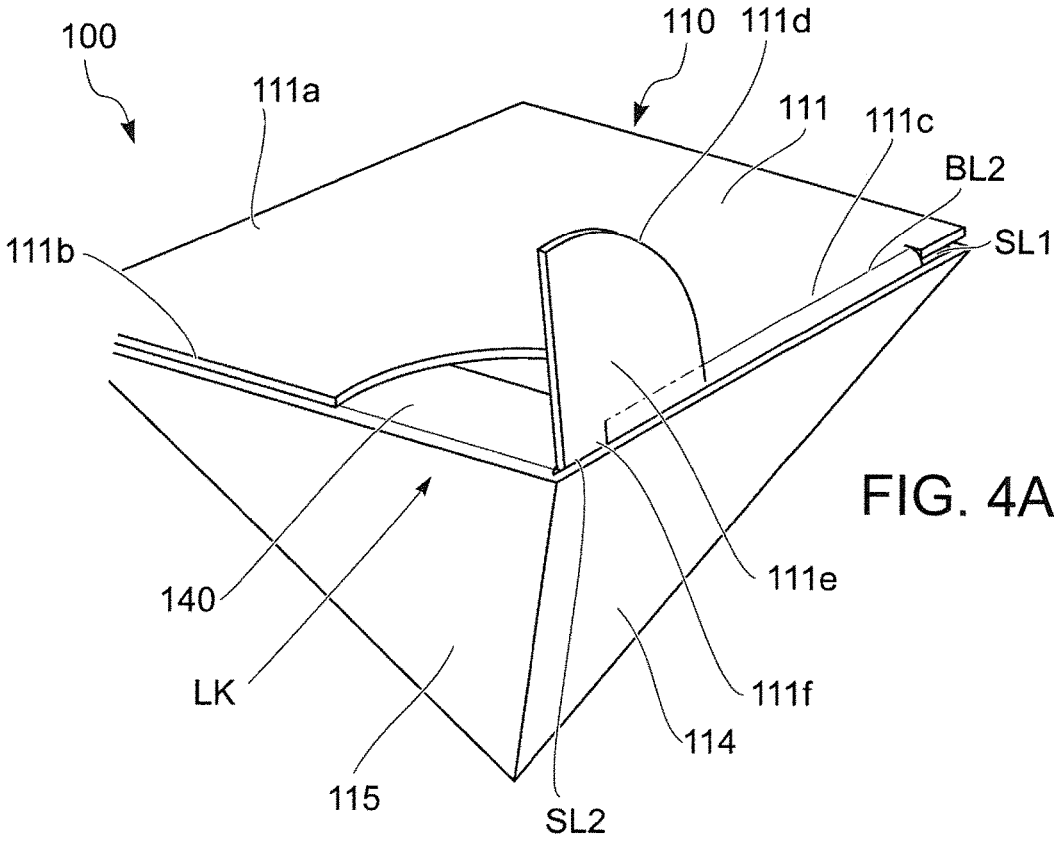
FIG. 4A is a front perspective view illustrating the behavior of the slit lock release gripping piece of the present invention.
Figure 4B:
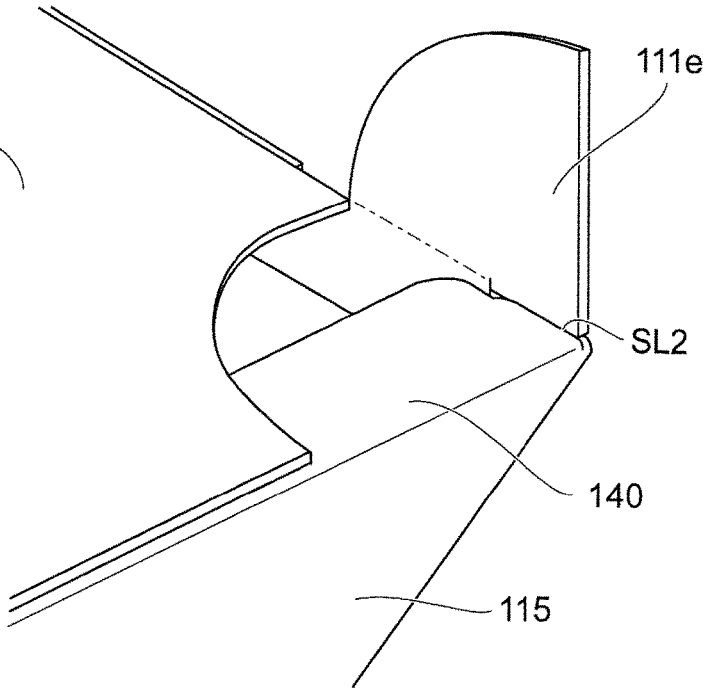
FIG. 4B is a rear perspective view illustrating the behavior of the slit lock release gripping piece of the present invention.
Figure 5A:
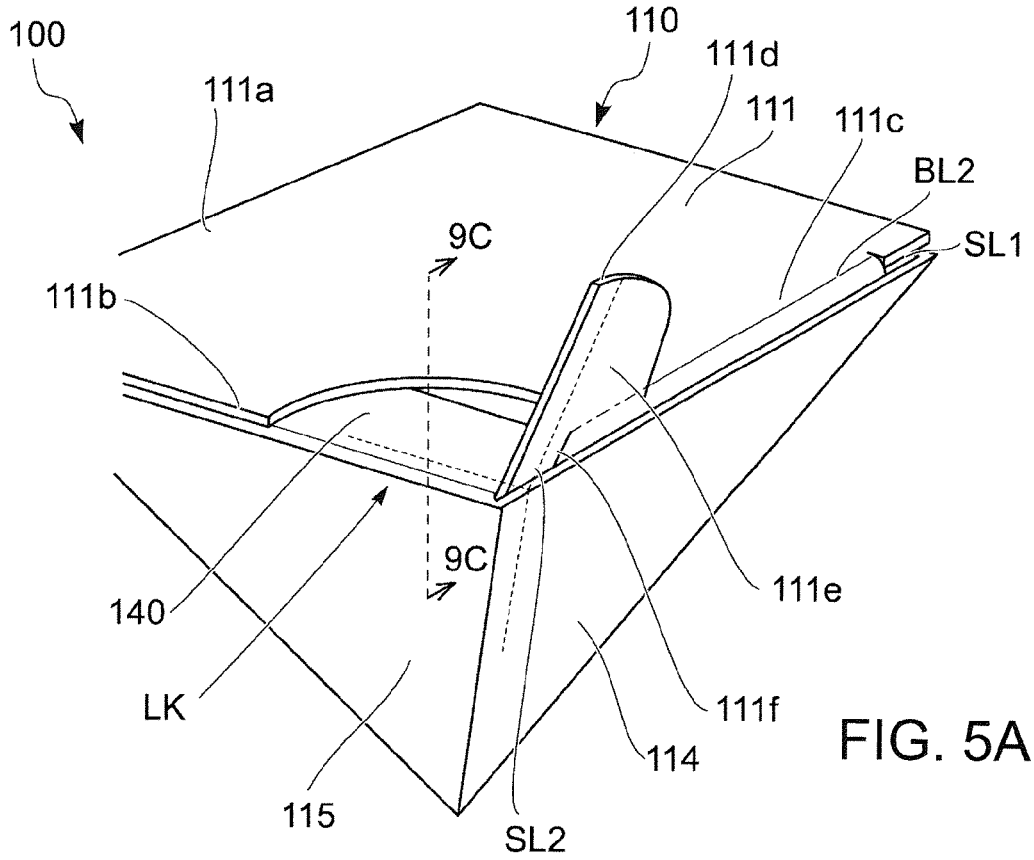
FIG. 5A is a front perspective view illustrating the behavior of the slit lock release gripping piece of the present invention.
Figure 5B:
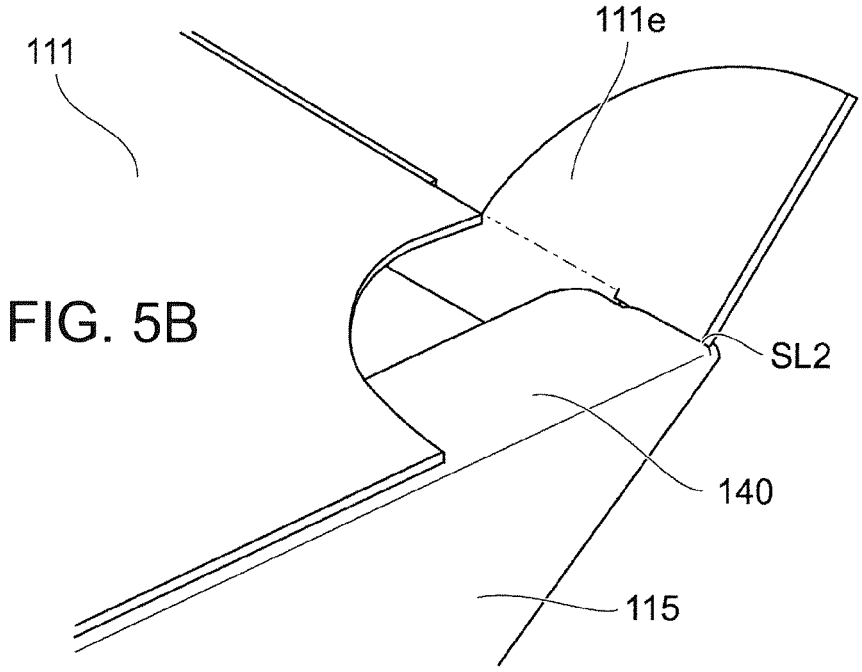
FIG. 5B is a rear perspective view illustrating the behavior of the slit lock release gripping piece of the present invention.

As illustrated in FIGS. 4A and 4B, the slit lock release gripping piece 111*e* is raised up from the state illustrated in FIGS. 3A and 3B due to a pulling force in upward and forward directions created by a human hand. As illustrated in FIGS. 5A and 5B, the insertion piece 120 is also pulled forward due to the pulling force created by a human hand from the state illustrated in FIGS. 4A and 4B. Then, the right slit SL2, which is the slit at a side of the insertion piece 120 in a lateral direction of the insertion piece 120 where the slit lock release gripping piece 111*e* is formed, moves forward with respect to the right slit engaging piece 141 of the right side flap 140, allowing the right slit engaging piece 141 to be taken out of the right slit SL2.

That is, the engagement between the insertion piece 120 and the right slit engaging piece 141 in the right slit SL2 is released. It is noted that, because the packing box 100 has flexibility, the front wall plate member 114 deforms in a greater or lesser degree due to a forward pulling force created by a human hand, allowing the right slit SL2 to move forward.

Figure 6A:
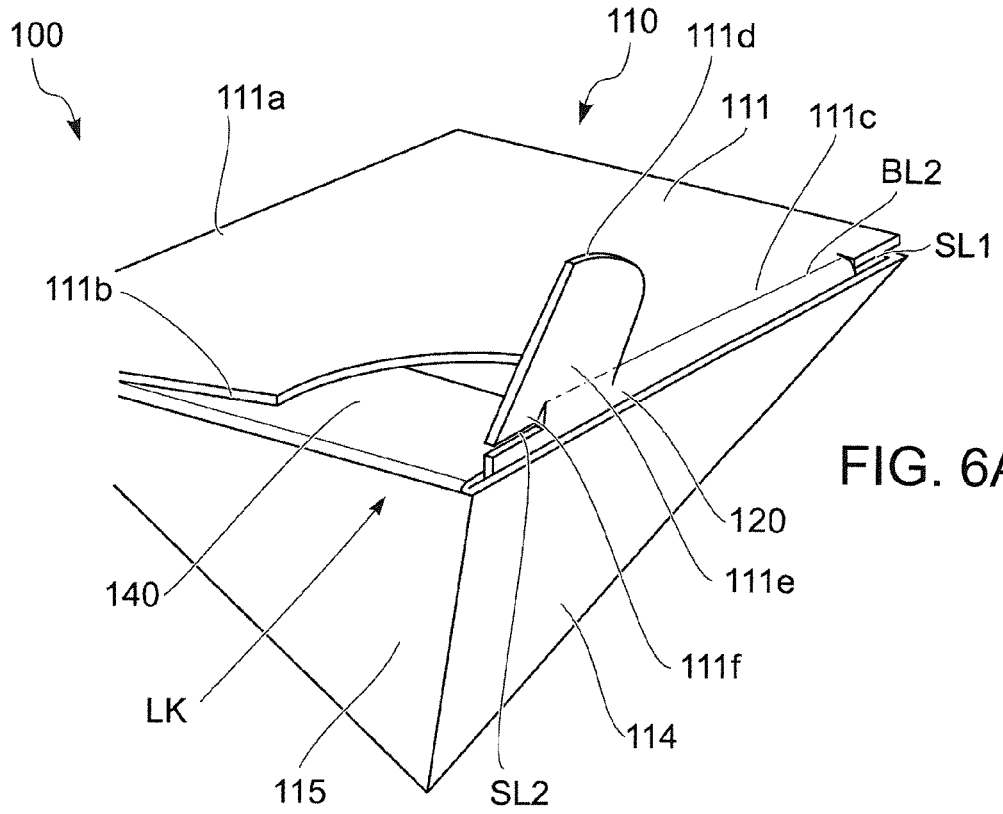
FIG. 6A is a front perspective view illustrating the behavior of the slit lock release gripping piece of the present invention.
Figure 6B:
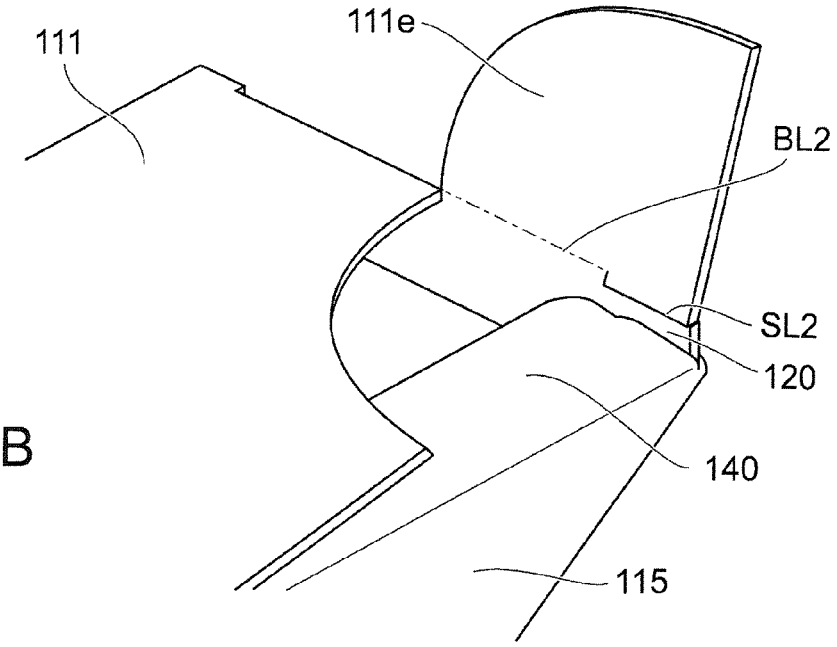
FIG. 6B is a rear perspective view illustrating the behavior of the slit lock release gripping piece of the present invention.

As illustrated in FIGS. 6A and 6B, the slit lock release gripping piece 111*e* is pulled upward and forward from the state illustrated in FIGS. 5A and 5B due to a pulling force in upward and forward directions created by a human hand. Then, the insertion piece 120 is also pulled upward and forward, causing the insertion piece 120 to move upward while the right slit engaging piece 141 is out of the right slit SL2.

Figure 7A:
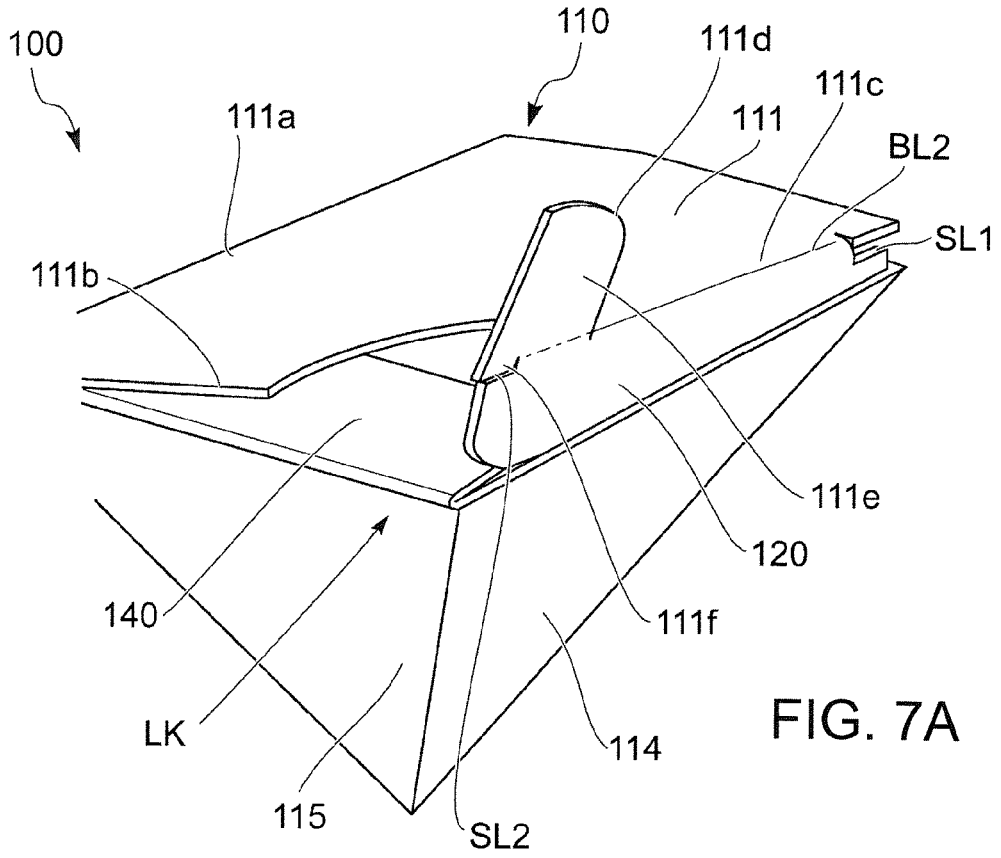
FIG. 7A is a front perspective view illustrating the behavior of the slit lock release gripping piece of the present invention.
Figure 7B:
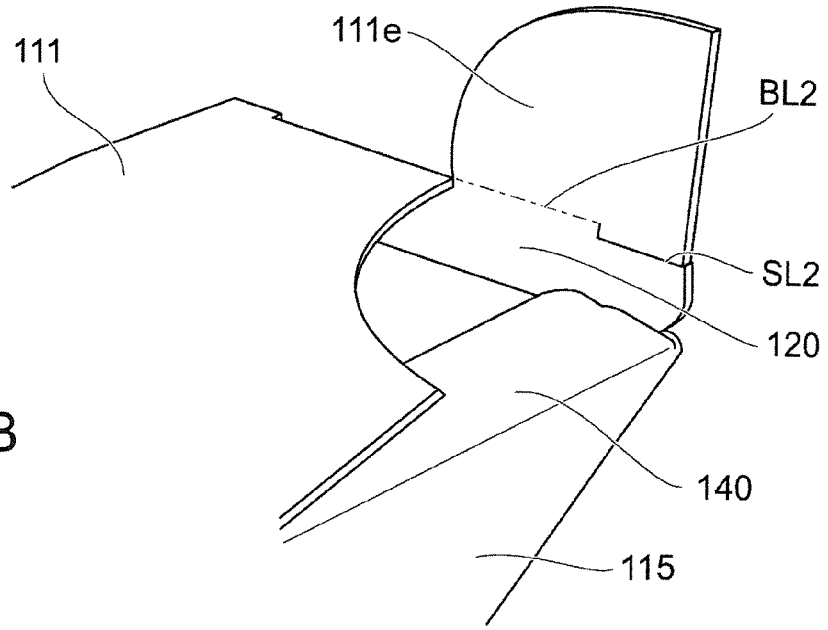
FIG. 7B is a rear perspective view illustrating the behavior of the slit lock release gripping piece of the present invention.

As illustrated in FIGS. 7A and 7B, due to the pulling force in upward and forward directions created by a human hand in the state illustrated in FIGS. 6A and 6B, the openable lid 111 starts to open while being slightly twisted such that one side of the openable lid 111 in the lateral direction thereof where the slit lock release gripping piece 111*e* is formed precedes the other side of the openable lid 111 in the lateral direction thereof. At this point, the insertion piece 120 is inclined with respect to the lateral direction, and the engagement between the insertion piece 120 and the left slit engaging piece 131 of the left side flap 130 in the left slit SL1 at the other side of the openable lid 111 in the lateral direction thereof is loosened.

The left slit SL1 then moves upward while being inclined with respect to the left slit engaging piece 131 of the left side flap 130, causing the left slit engaging piece 131 to be taken out of the left slit SL1. That is, the engagement between the insertion piece 120 and the left slit engaging piece 131 in the left slit SL1 is released.

Next, as illustrated in FIG. 8, due to an upward pulling force created by a human hand in the state illustrated in FIGS. 7A and 7B, the insertion piece 120 is taken out of the box body 110, and the openable lid 111 becomes an open state. As described above, because the pulling force created by a human hand acts upward and forward and the direction of the pulling force does not need to be inverted, the slit lock can be released smoothly to open the openable lid 111. Also, a fancy box housed in the packing box 100 can be taken out of the packing box 100 without using a tool such as a cutter.

Furthermore, as illustrated in FIGS. 9A to 9C, the right slit SL2 of the present invention is formed with the right L-shaped cut CT2 (see FIG. 2) and the insertion piece 120 in a folded state with respect to the openable lid 111. The right L-shaped cut CT2 is formed by cutting from a start point on the openable front end edge folding ruled line BL2, which is a border between the insertion piece 120 and the openable lid 111, toward a side of the insertion piece 120 for a length that is at least equal to a thickness d1 of the right side flap 140 and then cutting toward a side end of the insertion piece 120.

Also, a part of the openable lid 111 that projects forward from the openable front end edge folding ruled line BL2, which is the border between the insertion piece 120 and the openable lid 111, due to the right L-shaped cut CT2 when the insertion piece 120 is in the folded state with respect to the openable lid 111 forms an unlock projection piece 111*f*, The unlock projection piece 111*f* is configured so as to abut against the right slit engaging piece 141 in the right slit SL2 when the slit lock release gripping piece 111*e* is raised up to release the engagement created by the slit lock engaging structure LK.

Behavior and function of the unlock projection piece 111*f* will now be described. As illustrated in FIG. 9A, the right slit engaging piece 141 enters into the right slit SL2 having a size that is at least equal to the thickness d1 of the right side flap 140 to engage the insertion piece 120. Also, the unlock projection piece 111*f* projects forward from the openable front end edge folding ruled line BL2.

As illustrated in FIG. 9B, the slit lock release gripping piece 111*e*, which is a part of the openable lid 111, is torn along the tear inducing line 111*d* from the state illustrated in FIG. 9A and gripped by a human hand. Then, due to a pulling force acting in upward and forward directions created by a human hand, the slit lock release gripping piece 111*e* swings upward and forward around the openable front end edge folding ruled line BL2. At this moment, the unlock projection piece 111*f* provided across the openable front end edge folding ruled line BL2 from the slit lock release gripping piece 111*e* swings downward and rearward so as to close the right slit SL2 and abuts against the right slit engaging piece 141 in the right slit SL2.

The unlock projection piece 111*f* then pushes the right slit engaging piece 141 in the right slit SL2 rearward in a relative manner. At this moment, due to a reaction force from the right slit engaging piece 141, the openable front end edge folding ruled line BL2 and the slit lock release gripping piece 111*e*, the insertion piece 120 and the right slit SL2 in the vicinity of the openable front end edge folding ruled line BL2 slightly moves forward and the front wall plate member 114 deflects forward.

As illustrated in FIG. 9C, when the slit lock release gripping piece 111*e* further swings and is raised up by a human hand from the state illustrated in FIG. 9B, the unlock projection piece 111*f* closes the right slit SL2. Then, the unlock projection piece 111*f* pushes a front end of the right slit engaging piece 141, causing the openable front end edge folding ruled line BL2 and the slit lock release gripping piece 111*e*, the insertion piece 120, and the right slit SL2 in the vicinity of the openable front end edge folding ruled line BL2 to further move forward and the front wall plate member 114 to further deflect forward.

Accordingly, the right slit engaging piece 141 in the right slit SL2 is relatively pushed out of the right slit SL2, and the engagement between the insertion piece 120 and the right slit engaging piece 141 in the right slit SL2 is released. In other words, because the unlock projection piece 111*f* is provided, the engagement between the insertion piece 120 and the right slit engaging piece 141 in the right slit SL2 is released at a timing somewhere between FIGS. 4A and 5B, which makes it easier to open the openable lid 111.

It is noted that the timing at which this engagement is completely released depends on the relative positions of the insertion piece 120 and the slit lock release gripping piece 111*e*. That is, the engagement is completely released when the insertion piece 120 and the slit lock release gripping piece 111*e* are approximately aligned on a straight line. Although in the present embodiment the slit lock release gripping piece 111*e* is provided only on the right side in the lateral direction, it may be provided on the left side as well, or even on both sides of the lateral direction. Also, although the openable lid 111 is provided upward for the purpose of description, it may be provided downward or sideways. Also, although in the present embodiment one face of the polyhedron is adapted as the openable lid 111, multiple faces of the polyhedron may be adapted as the openable lid 111, so that a plurality of the openable lids 111 are provided.

Also, an open window may be formed on any one face of the polyhedron of the box body 110. This enables to see a product housed in the packing box 100 from outside through the open window. Also, by housing a product so that a bar code of product information labeled on the product is aligned with the position of the open window, the bar code on the product housed in the packing box 100 can be seen from outside through the open window.

Furthermore, at least one of the slit lock release gripping piece 111*e* and the right side flap 140, or the right side flap 140 in this embodiment, has a temporary gluing portion 142 on a face thereof opposing the other of the slit lock release gripping piece 111*e* and the right side flap 140, or the slit lock release gripping piece 111*e* in this embodiment. The temporary gluing portion 142 includes a glue applied thereto for gluing to, removing from, and regluing to the other. This enables the slit lock release gripping piece 111*e* to be temporarily glued so as to be in the same plane as the openable lid 111.

It is noted that, in the present embodiment, the insertion piece 120 is folded for approximately 120 degrees so as to from an acute angle with respect to the openable lid 111, and is inserted into the box body 110 along an inner surface of the front wall plate member 114, which is arranged at an acute angle with respect to the openable lid 111. When the angle between the openable lid 111 and the front wall plate member 114 is an acute angle, a tip portion of the insertion piece 120 is positioned closer to the base end of the openable lid 111 and the slit engaging piece of the side flap is inserted deeper into the slit in comparison with the case where the angle between the openable lid 111 and the front wall plate member 114 is a right angle. Thus, it is difficult to release the slit lock by inserting a human hand, or a fingertip, between the insertion piece 120 and the front wall plate member 114. Therefore, when the angle between the openable lid 111 and the front wall plate member 114 is an acute angle, the configuration including the slit lock release gripping piece 111*e* is still effective even if the interior of the box body 110 is not tightly filled.

Because the packing box 100 as the first embodiment of the present invention obtained as described above has a part of the openable lid 111 that can be torn along the tear inducing line 113*d* extending from the right flap opposing edge 111*b* opposing the right side flap 140 to the front end edge 111*c* of the openable lid 111 to form the slit lock release gripping piece 111*e* that can be used for releasing the engagement by the slit lock engaging structure LK by being torn along the tear inducing line 111*d* and raised up with respect to the openable lid 111 by a human hand, the engagement by the slit lock engaging structure LK, which is the engagement between the insertion piece 120 and the right side flap 140 in the right slit SL2 on the side in the lateral direction of the insertion piece 120 where the slit lock release gripping piece 111*e* is formed, can be easily released even if the interior of the box body 110 is tightly filled with a fancy box or the like.

Also, because the right slit SL2 is formed with the right L-shaped cut CT2 formed by cutting from a start point on the openable front end edge folding ruled line BL2, which is a border between the insertion piece 120 and the openable lid 111, toward a side of the insertion piece 120 for a length that is at least equal to the thickness d1 of the right side flap 140 and then cutting toward a side end of the insertion piece 120 and the insertion piece 120 folded with respect to the openable lid 111, and a part of the openable lid 111 that projects forward from the openable front end edge folding ruled line BL2, which is the border between the insertion piece 120 and the openable lid 111, when the insertion piece 120 is folded with respect to the openable lid 111 forms the unlock projection piece 111*f* that is able to abut against the right slit engaging piece 141 in the right slit SL2 when the slit lock release gripping piece 111*e* is raised up to release the engagement created by the slit lock engaging structure LK, the engagement by the slit lock engaging structure LK, which is the engagement between the insertion piece 120 and the right side flap 140 in the right slit SL2 on the side in the lateral direction of the insertion piece 120 where the slit lock release gripping piece 111*e* is formed, can be reliably released.

Also, because the tear inducing line 111*d* is formed in an arc-like shape that is orthogonal to the right flap opposing edge 111*b* and the front end edge 111*c* of the openable lid 111, the slit lock release gripping piece 111*e* can be formed by tearing along the tear inducing line 111*d* smoothly.

Also, because the arc-like shape of the tear inducing line 111*d* is an arc of a precise circle whose center is located at the cross-point CP of the front end edge 111*c* and the right flap opposing edge 111*b* of the openable lid 111, the slit lock release gripping piece 111*e* can be formed by tearing along the tear inducing line 111*d* more smoothly.

Also, because an open window is formed on any one face of the polyhedron, a user can check a product and a person in charge of product inspection, for example, can inspect a product.

Also, because at least one of the slit lock release gripping piece 111*e* and the right side flap 140, or the right side flap 140 in this embodiment, has a temporary gluing portion 142 on a face thereof opposing the other of the slit lock release gripping piece 111*e* and the right side flap 140, or the slit lock release gripping piece 111*e* in this embodiment, and the temporary gluing portion 142 includes a glue applied thereto for gluing to, removing from, and regluing to the other, the slit lock release gripping piece 111*e* can be returned to the position that is in the same plane as the openable lid 111, so that the packing box 100 can be used continuously with the slit rock even after the packing box 100 is once open and the slit rock is re-released as needed.

Second Embodiment

Figure 10:
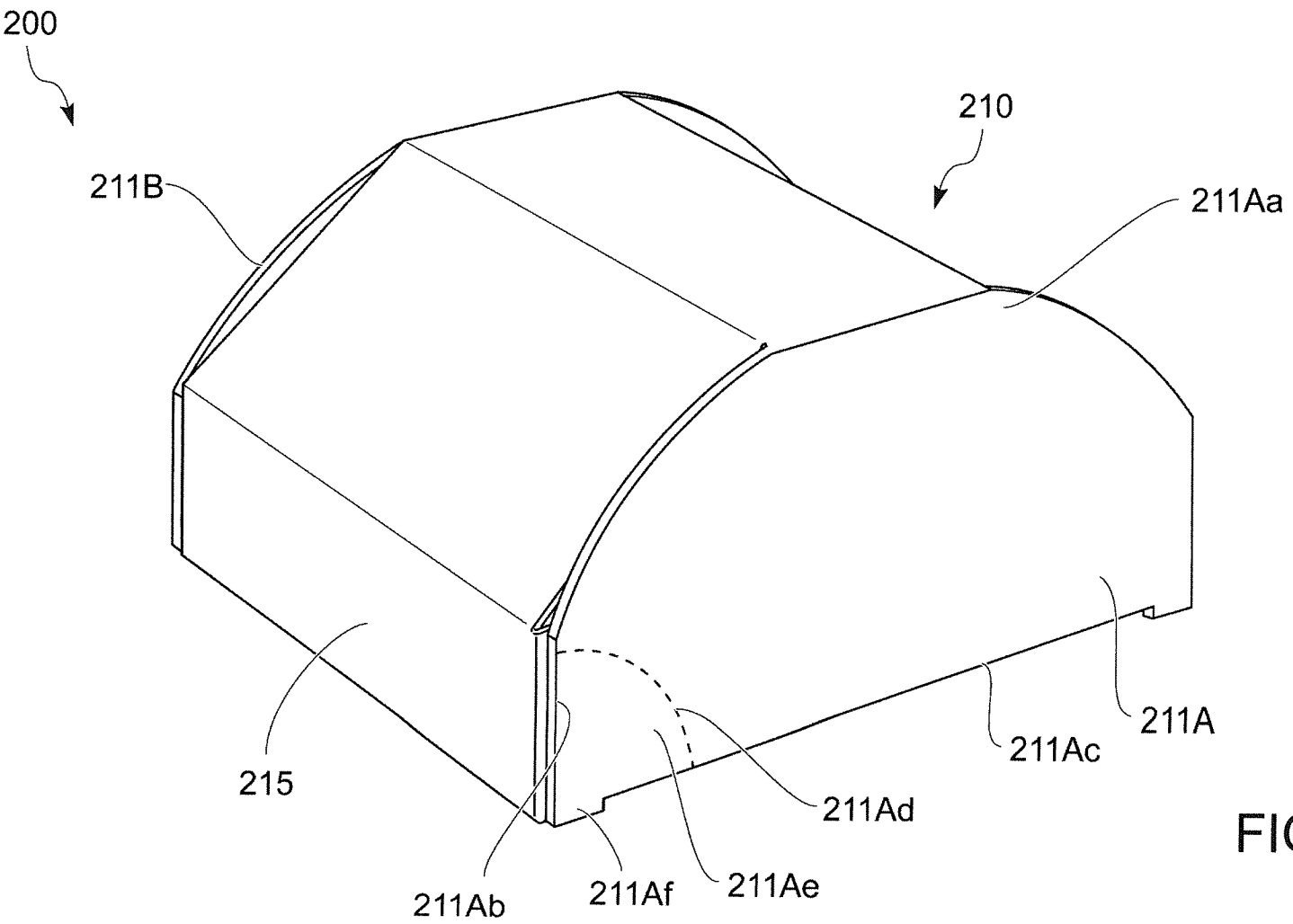
FIG. 10 is a perspective view schematically illustrating the packing box of a second embodiment of the present invention.

A packing box 200 of a second embodiment of the present invention will now be described with reference to FIGS. 10 and 11. FIG. 10 is a perspective view schematically illustrating the packing box 200 of the second embodiment of the present invention, and FIG. 11 is a development view of the packing box 200 of the second embodiment of the present invention.

The packing box 200 of the second embodiment is a modified version of the packing box 100 of the first embodiment where the number and shape of the faces of the polyhedron are modified and has many elements that are common with the packing box 100 of the first embodiment. Thus, the common elements will be identified with similar numbers in 200s and will not be described in detail.

Figure 11:
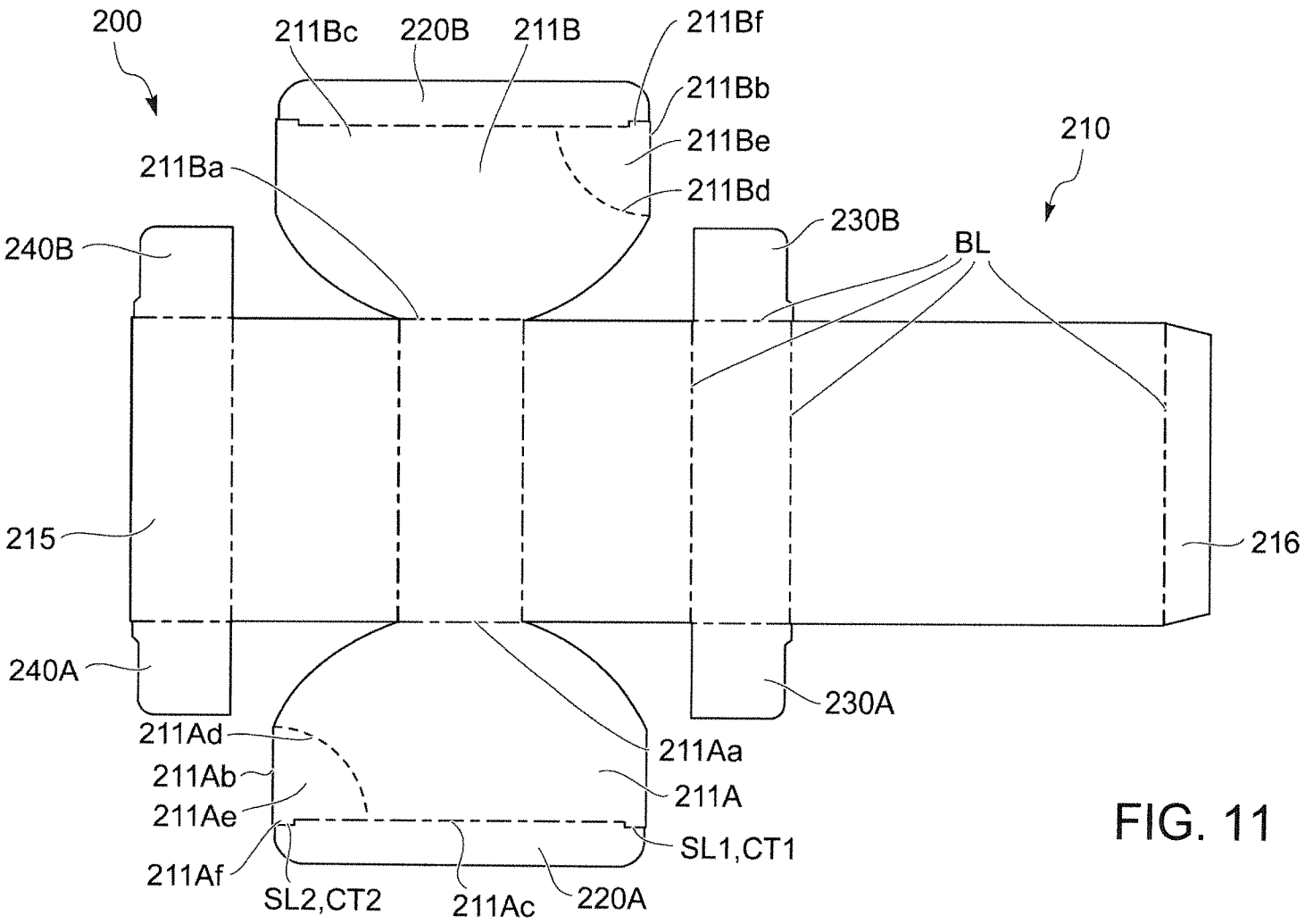
FIG. 11 is a development view of the packing box of the second embodiment of the present invention.

As illustrated in FIGS. 10 and 11, the packing box 200 as the second embodiment of the present invention is made of a thick coated cardboard, and includes a box body 210 having a so-called semicyrindrical shape (octahedron) as one example of a polyhedron with two openable lid 211A, 211B and being capable of housing a product (not shown), left side flaps 230A, 230B and right side flaps 240A, 240B as side flaps, and insertion pieces 220A, 220B respectively holding the openable lids 211A, 211B.

In the description of the present embodiment, for the purpose of illustration, the upside of the packing box 200 is where the openable lid 211A is located, the front side of the packing box 200 is where a front end edge 211Ac, which is a free end of the openable lid 211A, is located, and the rear side of the packing box 200 is where a base end 211Aa is located. The structure of a side of the openable lid 211B is similar to the structure of a side of the openable lid 211A and thus will not be described in detail.

The packing box 200 is constructed by folding inwardly along each of folding lines BL and grueling a margin 216 to an inner face of a right side wall plate member 215 with a glue, for example, to form side faces of the semicylindrical shape (octahedron) of the box body 210. The rest of the construction procedure is similar to that of the above-described first embodiment and thus will not be described in detail.

Because the packing box 200 of the second embodiment of the present invention obtained as described above has a part of the openable lid 211A that can be torn along a tear inducing line 211Ad extending from a right flap opposing edge 211Ab opposing the right side flap 240A to the front end edge 211Ac of the openable lid 211A to form a slit lock release gripping piece 211Ae that can be used for releasing the engagement by the slit lock engaging structure LK by being torn along the tear inducing line 211Ad and raised up with respect to the openable lid 211A by a human hand, the engagement by the slit lock engaging structure LK, which is the engagement between the insertion piece 220A and the right side flap 240A in the right slit SL2 on the side in the lateral direction of the insertion piece 220A where the slit lock release gripping piece 211Ae is formed, can be easily released even if the interior of the box body 210 is tightly filled with a product.

Third Embodiment

Figure 12:
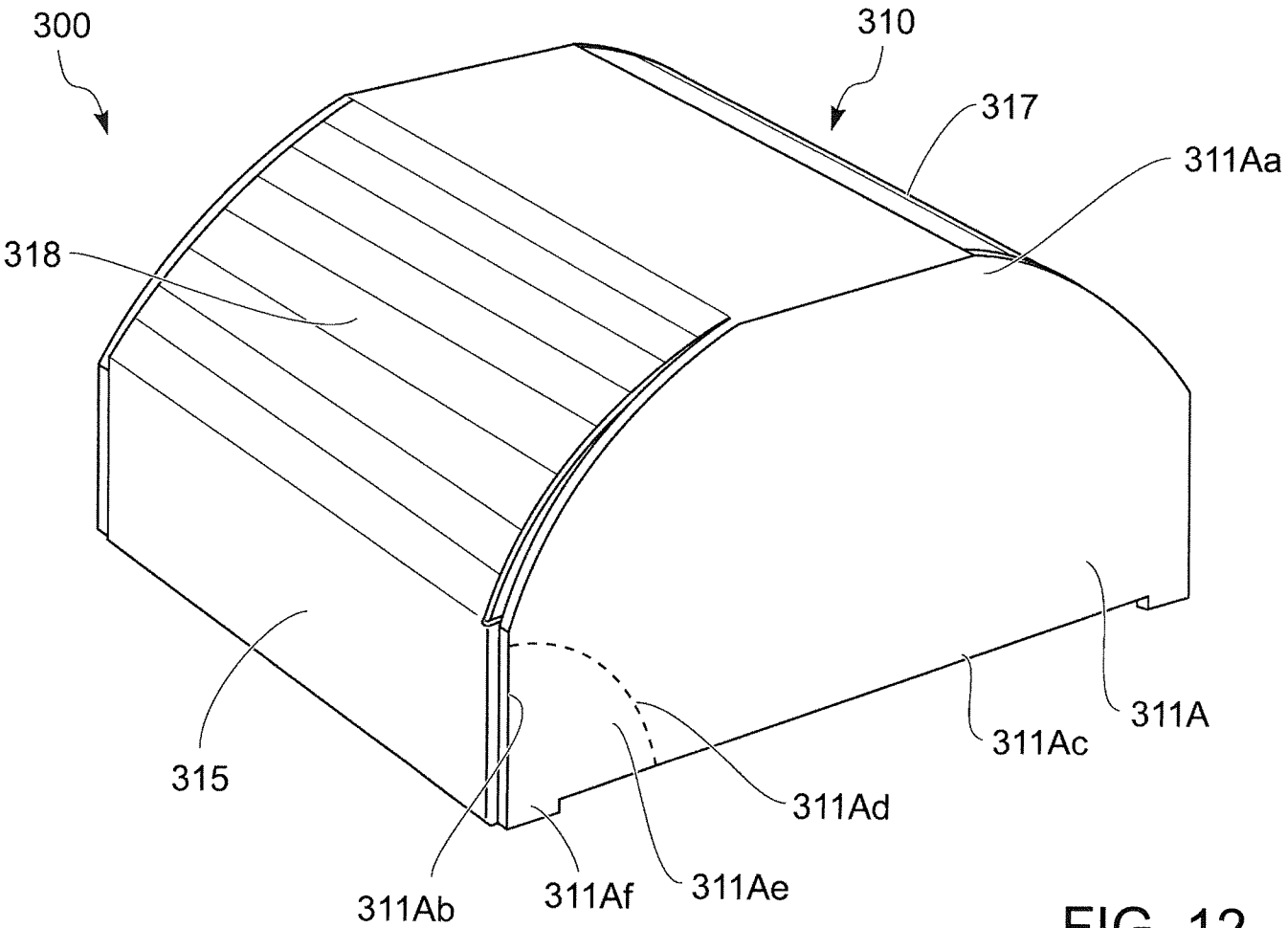
FIG. 12 is a perspective view schematically illustrating the packing box of a third embodiment of the present invention.

A packing box 300 of a third embodiment of the present invention will now be described with reference to FIGS. 12 and 13. FIG. 12 is a perspective view schematically illustrating the packing box 300 of the third embodiment of the present invention, and FIG. 13 is a development view of the packing box 300 of the third embodiment of the present invention.

The packing box 300 of the third embodiment is a modified version of the packing box 200 of the second embodiment where some faces of the polyhedron are modified as curved faces and has many elements that are common with the packing box 200 of the second embodiment. Thus, the common elements will be identified with similar numbers in 300s and will not be described in detail.

Figure 13:
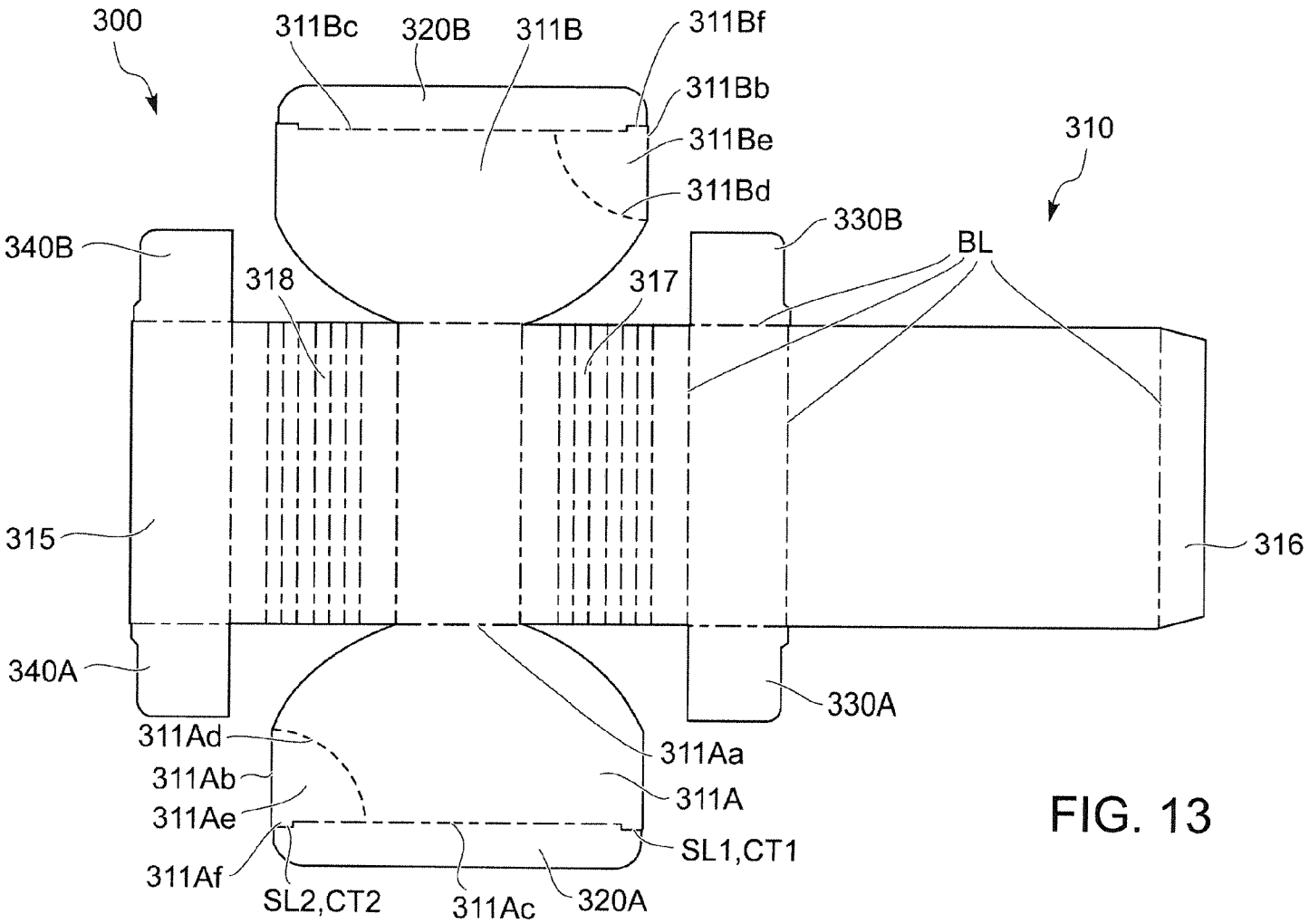
FIG. 13 is a development view of the packing box of the third embodiment of the present invention.

As illustrated in FIGS. 12 and 13, the packing box 300 of the third embodiment of the present invention is made of a thick coated cardboard, and includes a box body 310 having a so-called semicyrindrical shape (including two curved faces plus six flat faces) as one example of a polyhedron with two openable lid 311A, 311B and two curved faces and being capable of housing a product (not shown), left side flaps 330A, 330B and right side flaps 340A, 340B as side flaps, and insertion pieces 320A, 320B respectively holding the openable lids 311A, 311B. In the description of the present embodiment, for the purpose of illustration, the upside of the packing box 300 is where the openable lid 311A is located, the front side of the packing box 300 is where a front end edge 311Ac, which is a free end of the openable lid 311A, is located, and the rear side of the packing box 300 is where a base end 311Aa is located. The structure of a side of the openable lid 311B is similar to the structure of a side of the openable lid 311A and thus will not be described in detail.

The packing box 300 is constructed by folding a rear left curved surface 317 and a rear right curved surface 318 in an arc-like shape, folding other parts of the packing box 300 inwardly along each of folding lines BL, and grueling a margin 316 to an inner face of a right side wall plate member 315 with a glue, for example, to form side faces of the semicylindrical shape (having two curved faces plus six flat faces) of the box body 310. The rest of the construction procedure is similar to that of the above-described second embodiment and thus will not be described in detail.

Because the packing box 300 of the third embodiment of the present invention obtained as described above has a part of the openable lid 311A that can be torn along a tear inducing line 311Ad extending from a right flap opposing edge 311Ab opposing the right side flap 340A to the front end edge 311Ac of the openable lid 311 to form a slit lock release gripping piece 311Ae that can be used for releasing the engagement by the slit lock engaging structure LK by being torn along the tear inducing line 311Ad and raised up with respect to the openable lid 311A by a human hand, the engagement by the slit lock engaging structure LK, which is the engagement between the insertion piece 320A and the right side flap 340A in the right slit SL2 on the side in the lateral direction of the insertion piece 320A where the slit lock release gripping piece 311Ae is formed, can be easily released even if the interior of the box body 310 is tightly filled with a product. That is, even though the box body 310 of the packing box 300 is a polyhedron having curved faces such as the rear left curved surface 317 and the rear right curved surface 318, the same effects as the above-described second embodiment can be obtained.

Fourth Embodiment

Figure 14:
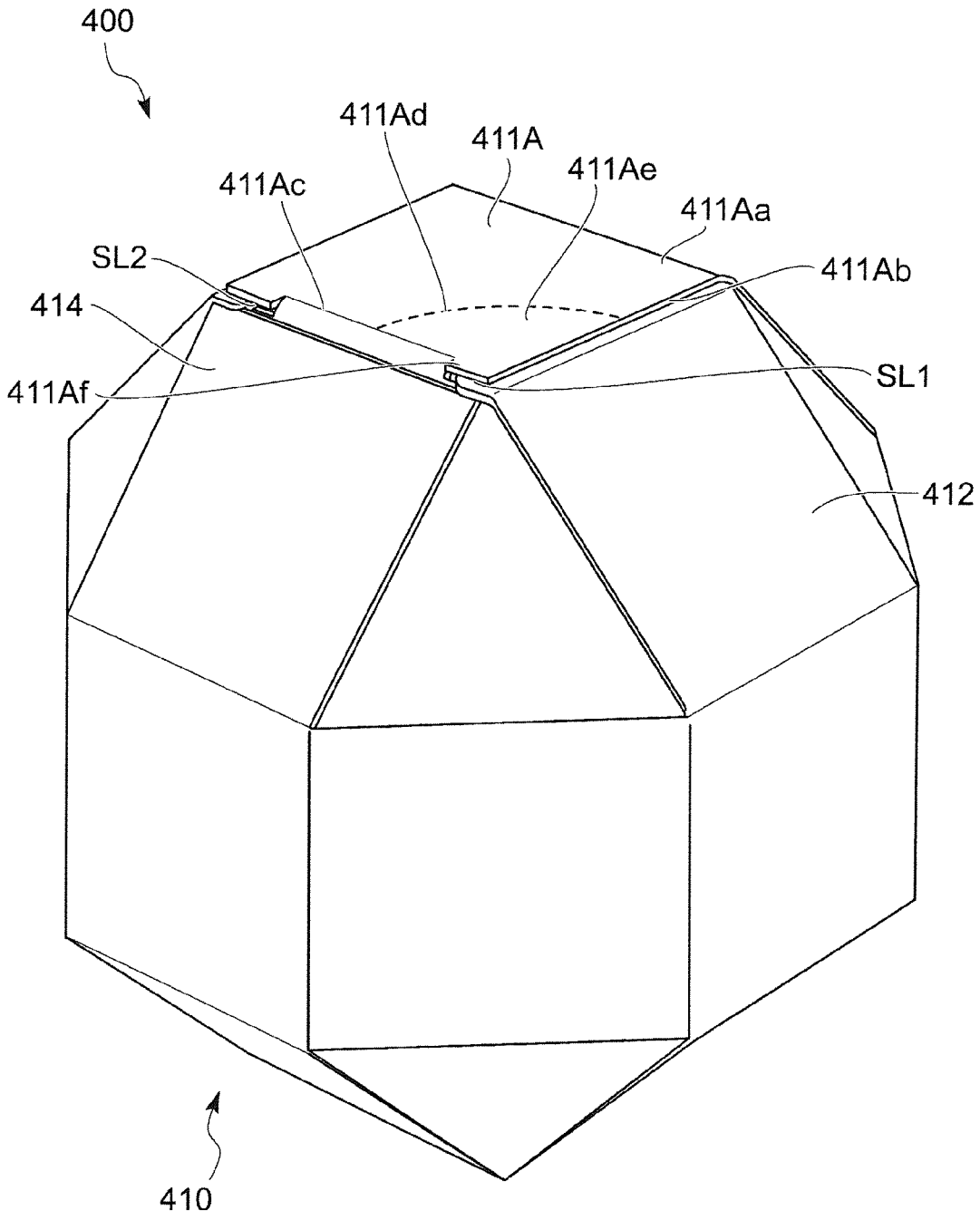
FIG. 14 is a perspective view schematically illustrating the packing box of a fourth embodiment of the present invention.

A packing box 400 of a fourth embodiment of the present invention will now be described with reference to FIGS. 14 and 15. FIG. 14 is a perspective view schematically illustrating the packing box 400 of the fourth embodiment of the present invention, and FIG. 15 is a development view of the packing box 400 of the fourth embodiment of the present invention.

The packing box 400 of the fourth embodiment is a modified version of the packing box 100 of the first embodiment where the number and shape of faces of the polyhedron as well as the number of the openable lids 111 are modified and has many elements that are common with the packing box 100 of the first embodiment. Thus, the common elements will be identified with similar numbers in 400s and will not be described in detail.

Figure 15:
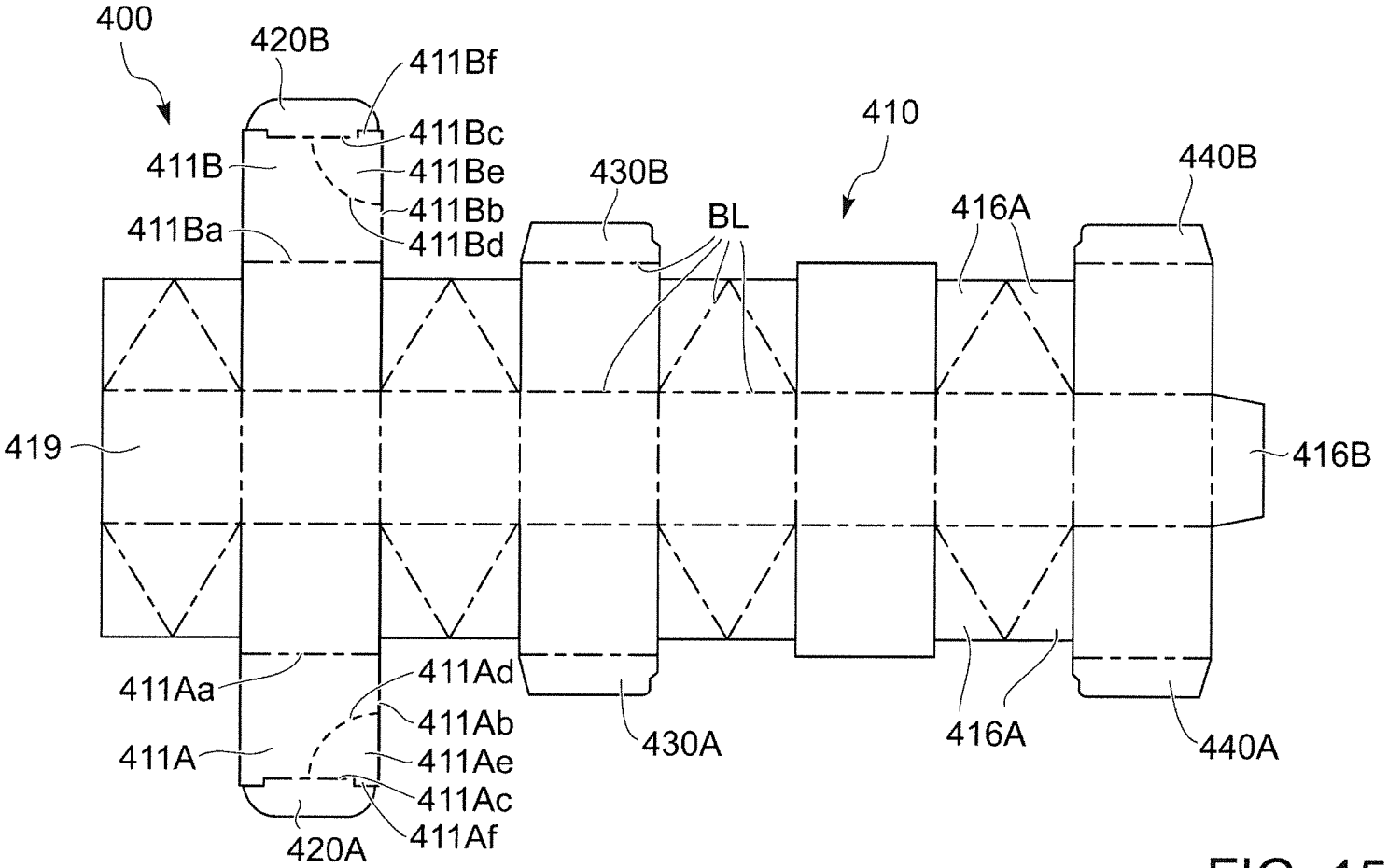

As illustrated in FIGS. 14 and 15, the packing box 400 of the fourth embodiment of the present invention is made of a thick coated cardboard, and includes a box body 410 that is a so-called rhombicuboctahedron (icosihexahedron) as one example of a polyhedron having two openable lid 411A, 411B and being capable of housing a product (not shown), left side flaps 430A, 430B and right side flaps 440A, 440B as side flaps, and insertion pieces 420A, 420B respectively holding the openable lids 411A, 411B. In the description of the present embodiment, for the purpose of illustration, the upside of the packing box 400 is where the openable lid 411A is located, the front side of the packing box 400 is where a front end edge 411Ac, which is a free end of the openable lid 411A, is located, and the rear side of the packing box 200 is where a base end 411Aa is located. The structure of a side of the openable lid 411B is similar to the structure of a side of the openable lid 411A and thus will not be described in detail.

The packing box 400 is constructed by folding inward along each of folding lines BL, grueling each triangular margin 416A adjacent to a triangular face to an inner face of a rectangular plate members 412 adjacent to the triangular margins 416A with a glue, for example, and grueling a rectangular margin 416B to an inner face of a rear right side plate member 419 with a glue, for example. The left side flap 430A and the right side flap 440A are then folded inward, and an insertion piece 420A of the openable lid 411A is inserted into the box body 410 to form the rhombicuboctahedron (icosihexahedron) of the box body 410.

It is noted that, in the present embodiment, the insertion piece 420A is folded at approximately 45 degrees so as to form an obtuse angle with respect to the openable lid 411A, and is inserted into the box body 410 along an inner surface of the front wall plate member 414, which is arranged at an obtuse angle with respect to the openable lid 411A. When the angle between the openable lid 411A and the front wall plate member 414 is an obtuse angle, it is difficult to insert a human hand, or particularly a fingertip, between the insertion piece 420 and the front wall plate member 414, because a force does not act on the front wall plate member 414 in a direction to widen a space between the insertion piece 420 and the front wall plate member 414. Therefore, when the angle between the openable lid 411A and the front wall plate member 414 is an obtuse angle, the configuration including a slit lock release gripping piece 411Ae is still effective even if the interior of the box body 140 is not tightly filled.

Because the packing box 400 of the fourth embodiment of the present invention obtained as described above has apart of the openable lid 411A that can be torn along a tear inducing line 411Ad extending from a left flap opposing edge 411Ab opposing a left side flap 430A to a front end edge 411Ac of the openable lid 411A to form the slit lock release gripping piece 411Ae that can be used for releasing the engagement by the slit lock engaging structure LK by being torn along the tear inducing line 411Ad and raised up with respect to the openable lid 411A by a human hand, the engagement by the slit lock engaging structure LK, which is the engagement between the insertion piece 420A and the left side flap 430A in the left slit SL1 on the side in the lateral direction of the insertion piece 420A where the slit lock release gripping piece 411Ae is formed, can be easily released even if the interior of the box body 410 is tightly filled with a product.

Fifth Embodiment

Figure 16:
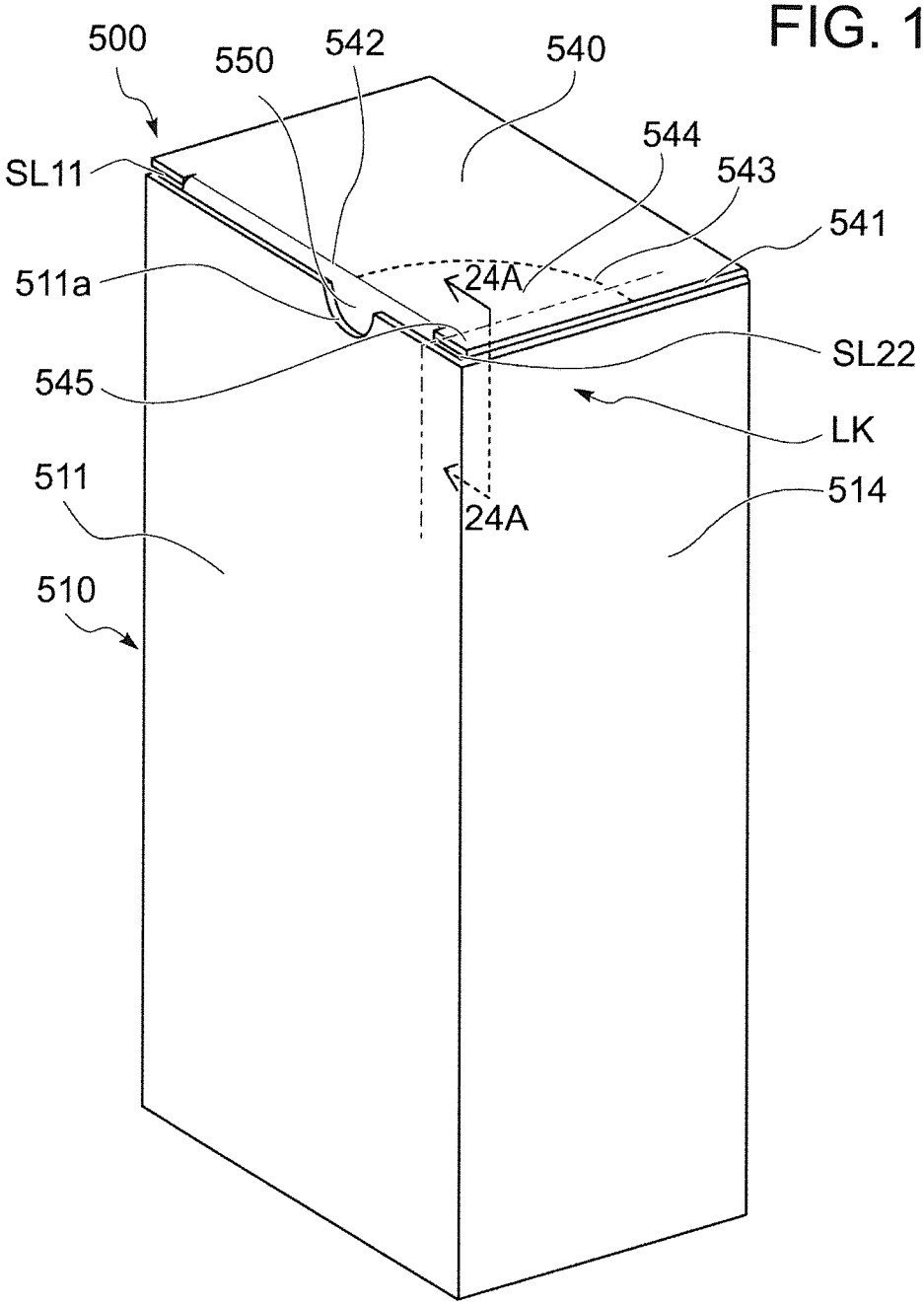
FIG. 16 is a front perspective view schematically illustrating the packing box of a fifth embodiment of the present invention.
Figure 17:
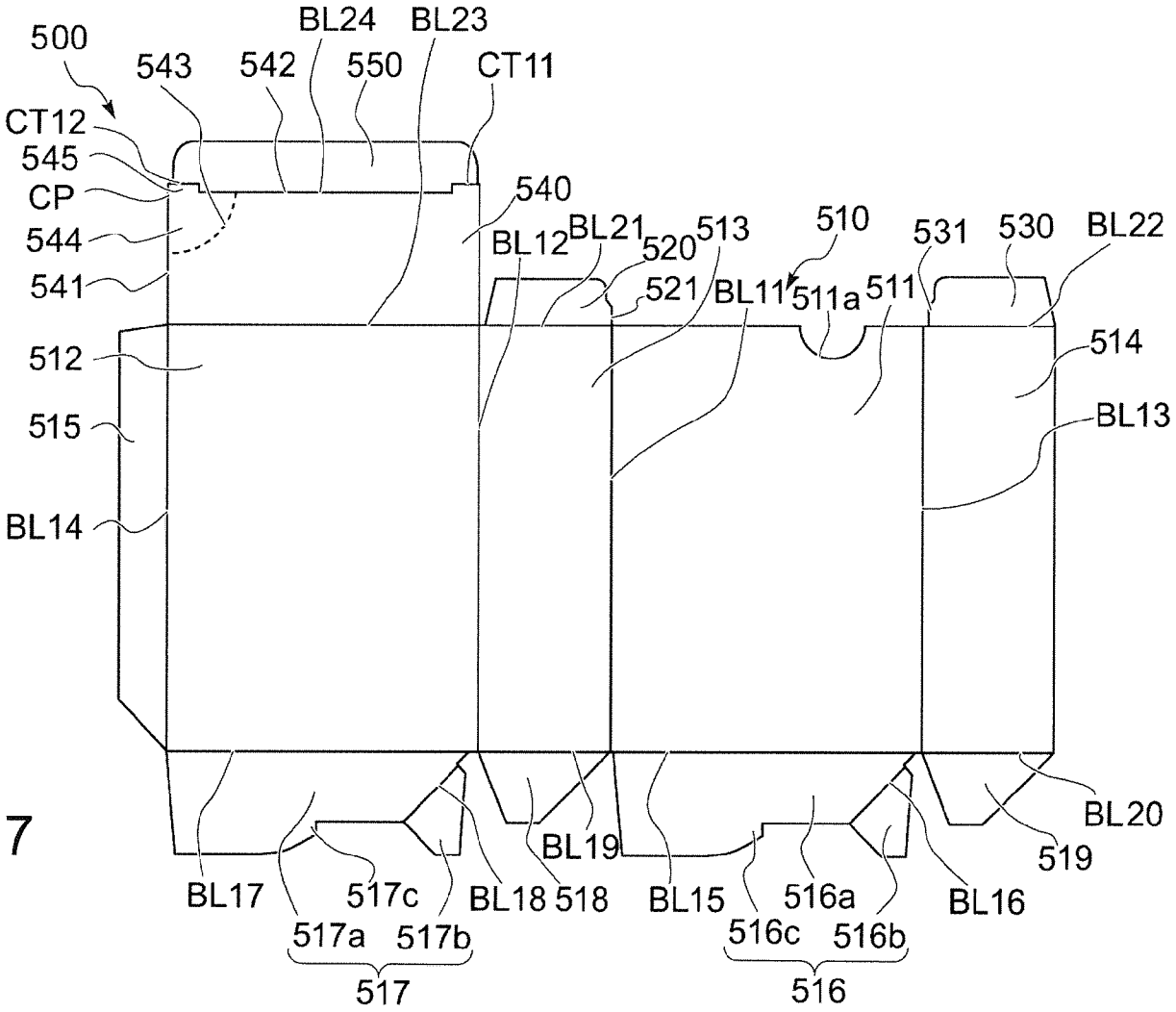
FIG. 17 is a development view of the packing box of the fifth embodiment of the present invention.
Figure 23:
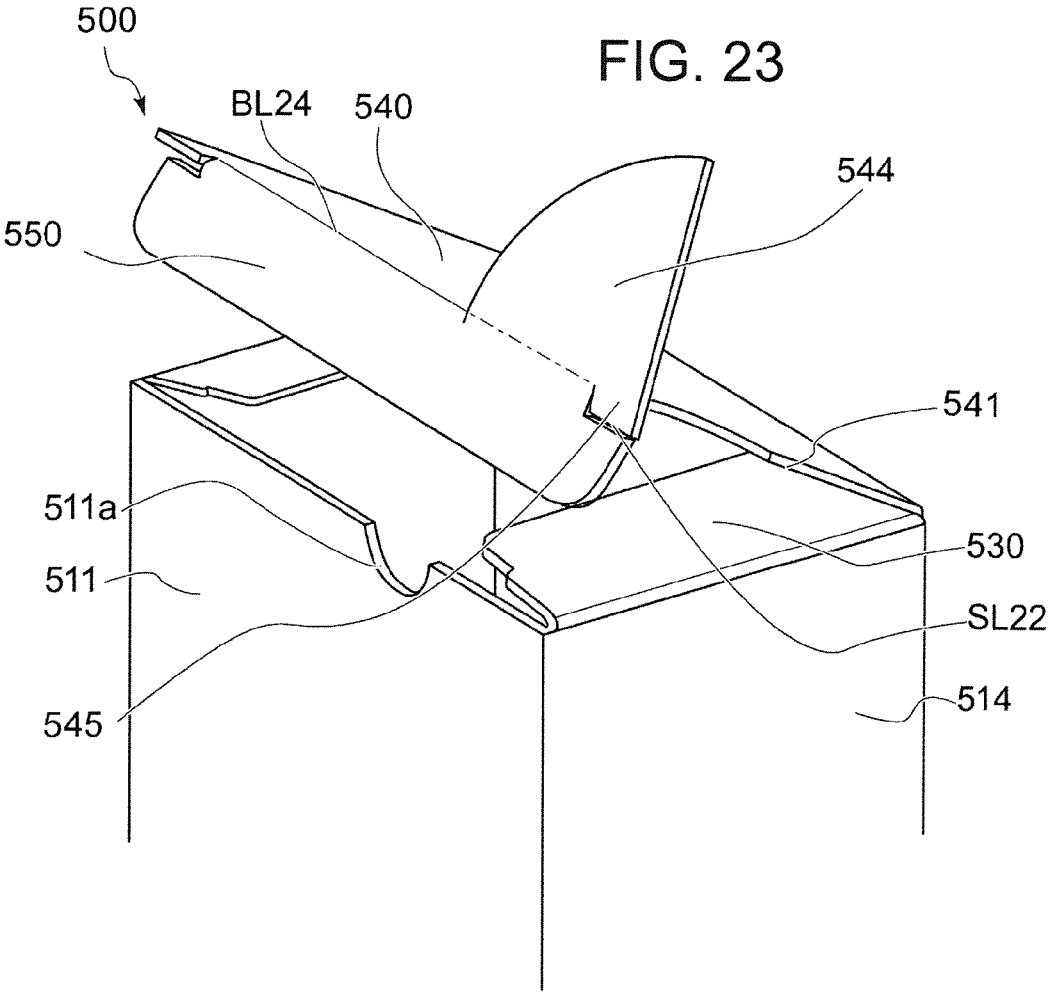
FIG. 23 is a front perspective view illustrating the state in which the top face lid, which is the openable lid of the packing box of the fifth embodiment, is open.
Figure 24A:
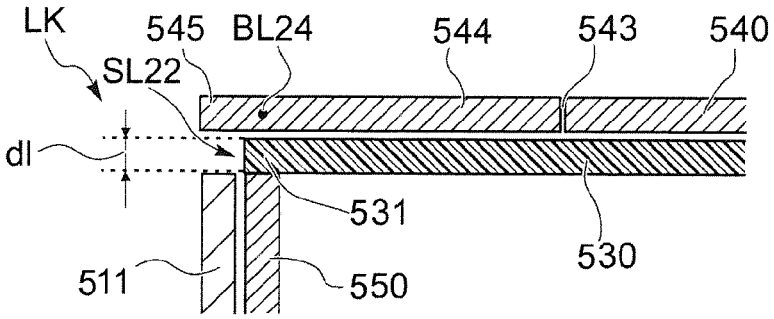
FIG. 24A is a sectional side view as seen in the direction indicated with reference numerals 24A-24A in FIG. 16.
Figure 24B:
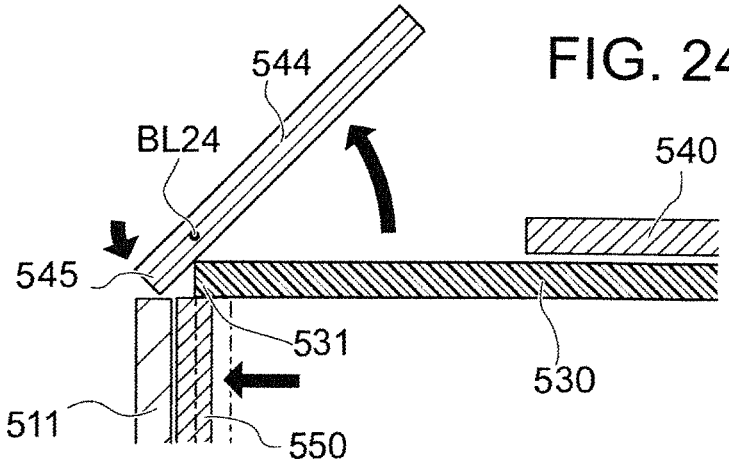
FIG. 24B is a sectional side view as seen in the direction indicated with reference numerals 24B-24B in FIG. 18A.
Figure 24C:
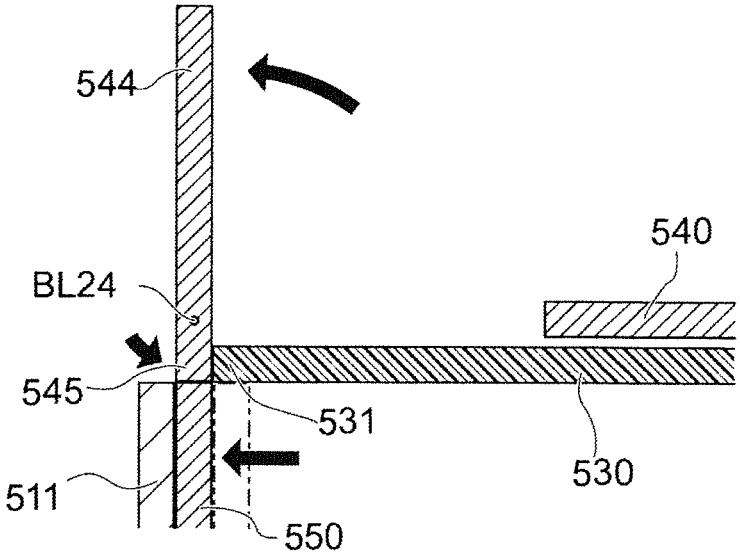
FIG. 24C is a sectional side view as seen in the direction indicated with reference numerals 24C-24C in FIG. 19A.

A packing box 500 of a fifth embodiment of the present invention will now be described with reference to FIGS. 16 to 24. FIG. 16 is a front perspective view schematically illustrating the packing box 500 of the fifth embodiment of the present invention. FIG. 17 is a development view of the packing box 500 of the fifth embodiment of the present invention. FIGS. 18A, 19A, 20A, 21A, and 22A are front perspective views illustrating the behavior of a slit lock release gripping piece 544 of the present invention. FIGS. 18B, 19B, 20B, 21B, and 22B are rear perspective views respectively corresponding to FIGS. 18A, 19A, 20A, 21A, and 22A. FIG. 23 is a front perspective view illustrating the state in which a top face lid 540, which is an openable lid of the packing box 500 of the present invention, is open. FIG. 24A is a sectional side view as seen in the direction represented with reference numerals 24B-24B in FIG. 18A. FIG. 24B is a sectional side view as seen in the direction represented with reference numerals 24B-24B in FIG. 18A. FIG. 24C is a sectional side view as seen in the direction represented with reference numerals 24C-24C in FIG. 19A.

As illustrated in FIGS. 16 and 17, the packing box 500 of the fifth embodiment of the present invention is made of a thick coated cardboard, and includes an openable lid 540 that constitutes at least one face of a box body 510 for housing a product and that is freely swung around a base end to seal a product taking-in/out opening formed at a position of the one face, side flaps 520, 530 that are laterally positioned with respect to the openable lid 540 and are respectively connected to openable lid side edge portions of lid side members constituting parts of a polyhedron via a folding line to prevent protrusion of the product, and an insertion piece that is connected to a front end edge of the openable lid 540 via a folding line and that is inserted into the box body 510 to hold the openable lid 540. In other words, the packing box 500 includes the box body 510 to house a fancy box (not shown) as one example of the product, the right flap 520 and the left flap 530 as side flaps for preventing protrusion of the fancy box, the openable lid 540 consisting of the top face lid to openably seal an upper end portion of the box body 510, and an insertion piece 550 that is inserted into the box body 510 to hold the top face lid 540. In the description of the present embodiment, "left" and "right" are left and right with respect to the packing box 500 that has been constructed. In other words, "left" and "right" are left and right of the packing box 500 as seen from a rear wall plate member 512 toward a front wall plate member 511 of the packing box 500.

As illustrated in FIG. 17, the box body 510 includes the front wall plate member 511, the rear wall plate member 512, a plurality of side wall plate members including a right side wall plate member 513 and a left side wall plate member 514, a rear wall margin 515, and bottom plate members including a front side bottom plate member 516, a rear side bottom plate member 517, a right bottom plate member 518 and a left bottom plate member 519. The right side wall plate member 513 is connected to a right end portion of the front wall plate member 511 via a wall right end folding ruled line BL11, which is a folding line. The rear wall plate member 512 is connected to a rear end portion of the right side wall plate member 513 via a rear wall right end folding ruled line BL12, which is a folding line.

The left side wall plate member 514 is connected to a left end portion of the front wall plate member 511 via a front wall left end folding ruled line BL13, which is a folding line. The rear wall margin 515 is connected to a left end portion of the rear wall plate member 512 via a rear wall left end folding ruled line BL14, which is a folding line. The front side bottom plate member 516 is connected to a lower end portion of the front wall plate member 511 via a front wall lower end folding ruled line BL15, which is a folding line. Also, the front side bottom plate member 516 includes a front side bottom base 516*a*, a front side bottom margin 516*b*, and a front side bottom tongue piece 516*c*, and the front side bottom margin 516*b* is connected to the front side bottom base 516*a* via a front side bottom folding ruled line BL16, which is a folding line.

Similar to the front side bottom plate member 516, the rear side bottom plate member 517 is connected to a lower end of the rear wall plate member 512 via a rear wall lower end folding ruled line BL17, which is a folding line. Also, the rear side bottom plate member 517 includes a rear side bottom base 517*a*, a rear side bottom margin 517*b*, and a rear side bottom tongue piece 517*c*, and the rear side bottom margin 517*b* is connected to the rear side bottom base 517*a* via a rear side bottom folding ruled line BL18, which is a folding line. The right bottom plate member 518 is connected to a lower end of the right side wall plate member 513 via a right side wall lower end folding ruled line BL19, which is a folding line. Similar to right bottom plate member 518, the left bottom plate member 519 is connected to a lower end of the left side wall plate member 514 via a left side wall lower end folding ruled line BL20, which is a folding line.

When the packing box 500 is constructed, the front wall plate member 511 and the right side wall plate member 513 are folded with respect to each other along the front wall right end folding ruled line BL11 so that an angle therebetween becomes 90 degrees, and the right side wall plate member 513 and the rear wall plate member 512 are folded with respect to each other along the rear wall right end folding ruled line BL12 so that an angle therebetween becomes 90 degrees, for example. Similarly, the front wall plate member 511 and the left side wall plate member 514 are folded with respect to each other along the front wall left end folding ruled line BL13 so that an angle therebetween becomes 90 degrees, and the rear wall plate member 512 and the rear wall margin 515 are folded with respect to each other along the rear wall left end folding ruled line BL14 so that an angle therebetween becomes 90 degrees.

Then, the rear wall margin 515 is glued to a rear end portion of an inner face of the left side wall plate member 514 with a glue, for example, making the outer circumference of the box body 510 rectangular in a planar view. Next, the box body 510 is temporarily deformed so that the cross section of the box body 510 in a planar view becomes a parallelogram, and the front side bottom margin 516*b* is glued to an outer face of the left bottom plate member 519 with a glue, for example. Similarly, the rear side bottom margin 517*b* is glued to an outer face of the right bottom plate member 518 with a glue, for example.

Then, the deformed the box body 510 is returned to the original state so that the shape of the cross section of the box body 510 in a planar view changes from the parallelogram to a rectangle having right angles. Accordingly, the front side bottom plate member 516, which is folded along the front side bottom folding ruled line BL16, becomes unfolded and the rear side bottom plate member 517, which is folded along the rear side bottom folding ruled line BL18, also becomes unfolded. Also, the front side bottom tongue piece 516*c* is inserted into an inner face side of the rear side bottom base 517*a* and the rear side bottom tongue piece 517*c* is also inserted into an inner face side of the front side bottom base 516*a*. Then, the front side bottom tongue piece 516*c* and the rear side bottom tongue piece 517*c* engage with each other, and an edge portion of the front side bottom base 516*a* and an edge portion of the rear side bottom base 517*a* engage with each other, making the box body 510 stable in a state where the cross section of the box body 510 in a planar view is rectangular, or where the box body 510 is able to house a fancy box.

Also, the right side flap 520 is connected to the openable lid side edge portion of the lid side member, that is, an upper end portion of the right side wall plate member 513, via a right side wall upper end folding ruled line BL21, which is a folding line. Similarly, the left side flap 530 is connected to the openable lid side edge portion of the lid side member, that is, an upper end portion of the left side wall plate member 514, via a left side wall upper end folding ruled line BL22, which is a folding line. A base end of the top face lid 540, which is an openable lid, is connected to an upper end portion of the rear wall plate member 512 via a rear wall upper end folding ruled line BL23, which is a folding line. The insertion piece 550 is connected to a front end edge 542 of the top face lid 540 via a top face front end edge folding ruled line BL24, which is a folding line.

The packing box 500 has a slit lock engaging structure LK in which the openable lid 540, or the top face lid, is maintained in a closed state by engaging a part of the side flap into a slit created by partially cutting a connection base end of the insertion piece 550 along the top face front end edge folding ruled line BL24. Specifically, a right L-shaped cut CT11 and a left L-shaped cut CT22 exist in the vicinity of the top face front end edge folding ruled line BL24 of the insertion piece 550. By folding the insertion piece 550 along the top face front end edge folding ruled line BL24 toward the top face lid 540, a right slit SL11 and a left slit SL22, which are gaps between the insertion piece 550 and the top face lid 540, are formed. In the present embodiment, due to a relatively large thickness of the material of the packing box 500, the slits (SL11 and SL22) are formed with the L-shaped cuts (CT11 and CT22). If the thickness of the material of the packing box 500 is relatively small, however, the slits may be formed with simple straight cuts, or I-shaped cuts.

A right slit engaging piece 521 formed at a front end of the right side flap 520 then enters into the right slit SL11, making the insertion piece 550 being engaged by the right slit engaging piece 521 in the right slit SL11. Similarly, a left slit engaging piece 531 formed at a front end of the left side flap 530 enters into the left slit SL22, making the insertion piece 550 being engaged by the left slit engaging piece 531 in the left slit SL22.

In the present embodiment, a tear inducing line 543, which is a perforated line, for example, extends from a left flap opposing edge 541, which is a flap opposing edge of the top face lid 540 as an openable lid, to a front end edge 542 of the top face lid 540. A part of the top face lid 540 can be torn along the tear inducing line 543 and be raised up with respect to top face lid 540 by a human hand to form a slit lock release gripping piece 544 that can be used for releasing the engagement by the slit lock engaging structure LK.

Figure 18A:
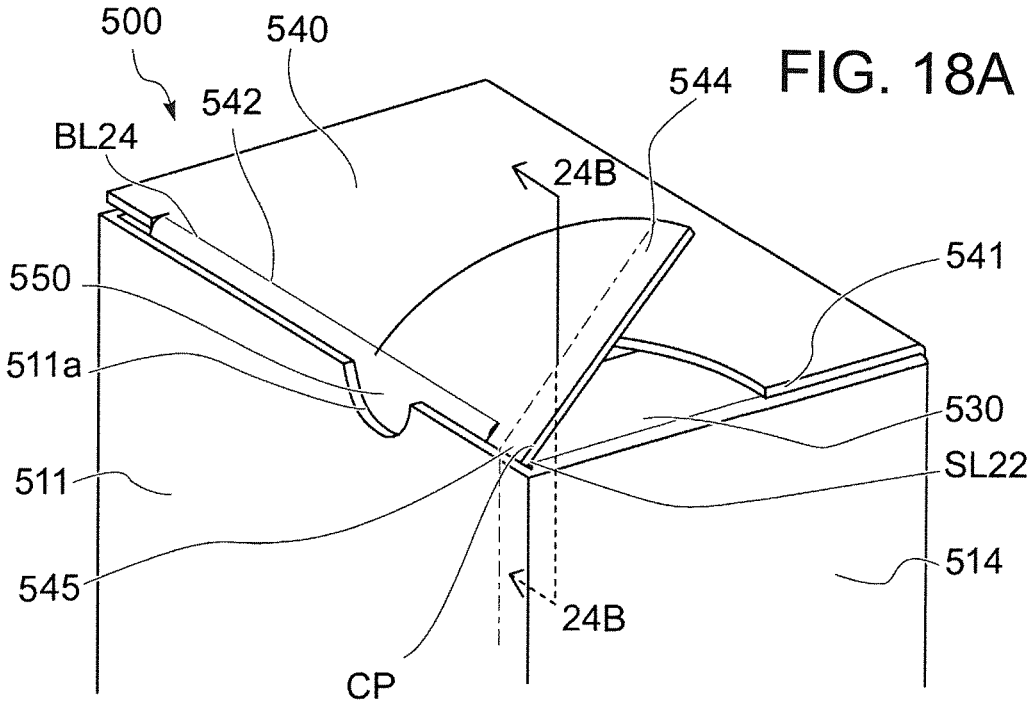
FIG. 18A is a front perspective view illustrating the behavior of the slit lock release gripping piece of the fifth embodiment.
Figure 18B:
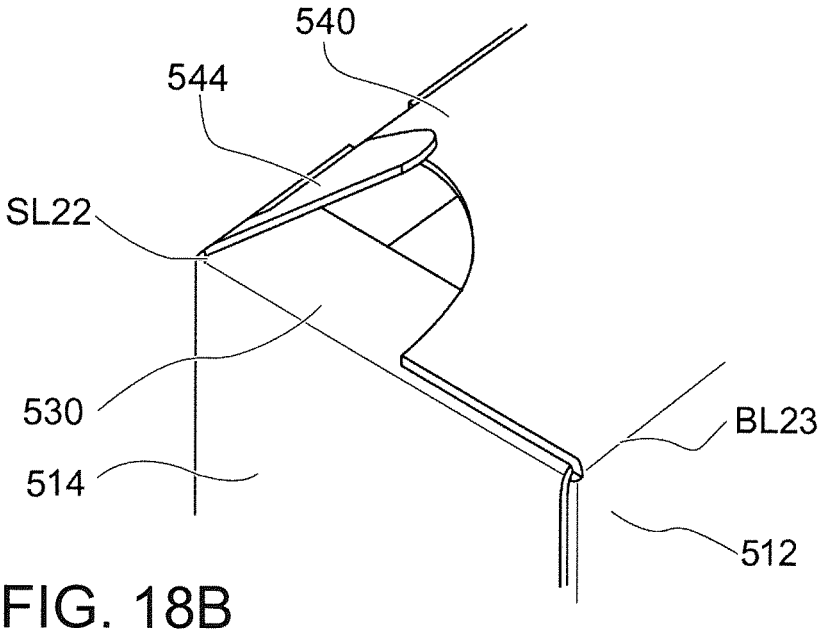
FIG. 18B is a rear perspective view illustrating the behavior of the slit lock release gripping piece of the fifth embodiment.

Behavior and function of the slit lock release gripping piece 544 will now be described. As illustrated in FIGS. 18A and 18B, when the top face lid 540 is opened from the state illustrated in FIG. 16, a part of the top face lid 540 is torn from the left flap opposing edge 541 of top face lid 540 due to a pulling force in upward and forward directions created by a human hand and forms the slit lock release gripping piece 544. At this moment, the slit lock release gripping piece 544 takes a slightly raised position with respect to the rest of the top face lid 540.

In the present embodiment, the tear inducing line 543 is formed in an arc-like shape that is orthogonal to the left flap opposing edge 541 and the front end edge 542 of the top face lid 540 as an openable lid. Thus, when a part of the top face lid 540 is raised up from the left flap opposing edge 541 of the top face lid 540 by a human hand, the direction of a stress acting on the tear inducing line 543 gradually changes from the direction orthogonal to the left flap opposing edge 541 to the direction orthogonal to the front end edge 542 of the top face lid 540. Also, the point on which the stress acts does not stay on a single location on the tear inducing line 543 but moves gradually from the left flap opposing edge 541 to the front end edge 542 of top face lid 540 in an arc-like manner. That is, the tearing along the tear inducing line 543 is executed smoothly.

Also, the arc-like shape of the tear inducing line 543 is an arc of a precise circle whose center is located at a cross-point CP of the front end edge 542 and the left flap opposing edge 541 of the top face lid 540. Thus, when a part of the top face lid 540 is raised up from the left flap opposing edge 541 of the top face lid 540 by a human hand, the amount of the stress acting along the tear inducing line 543 is substantially equalized in accordance with the radius of the precise circle and a load acting from a human hand is also substantially homogenized. That is, the tearing along the tear inducing line 543 is executed more smoothly.

Figure 19A:
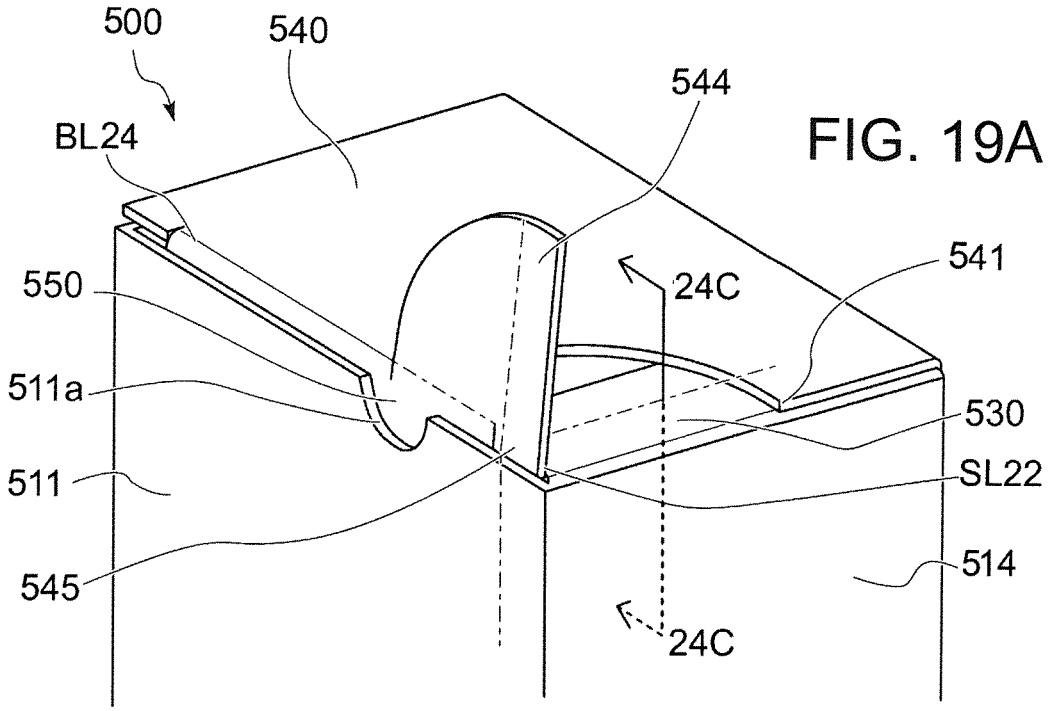
FIG. 19A is a front perspective view illustrating the behavior of the slit lock release gripping piece of the fifth embodiment.
Figure 19B:
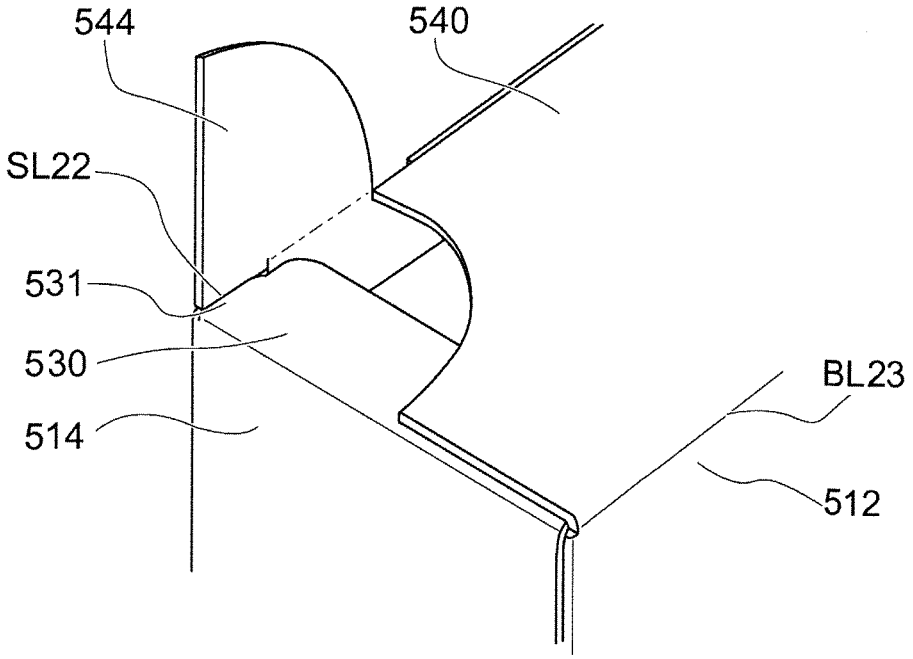
FIG. 19B is a rear perspective view illustrating the behavior of the slit lock release gripping piece of the fifth embodiment.
Figure 20A:
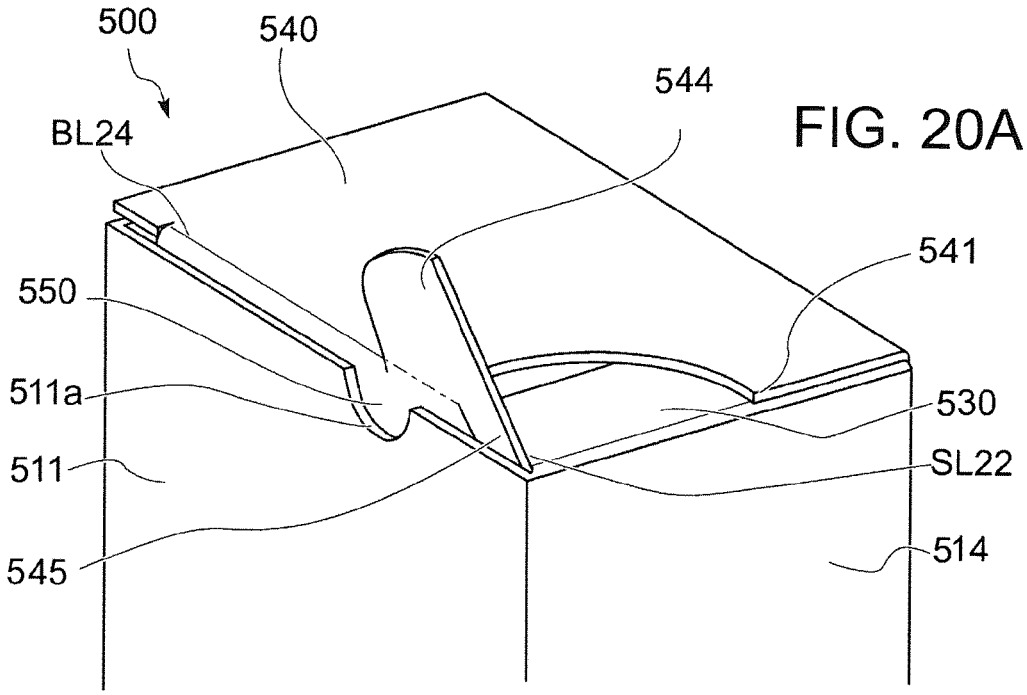
FIG. 20A is a front perspective view illustrating the behavior of the slit lock release gripping piece of the fifth embodiment.
Figure 20B:
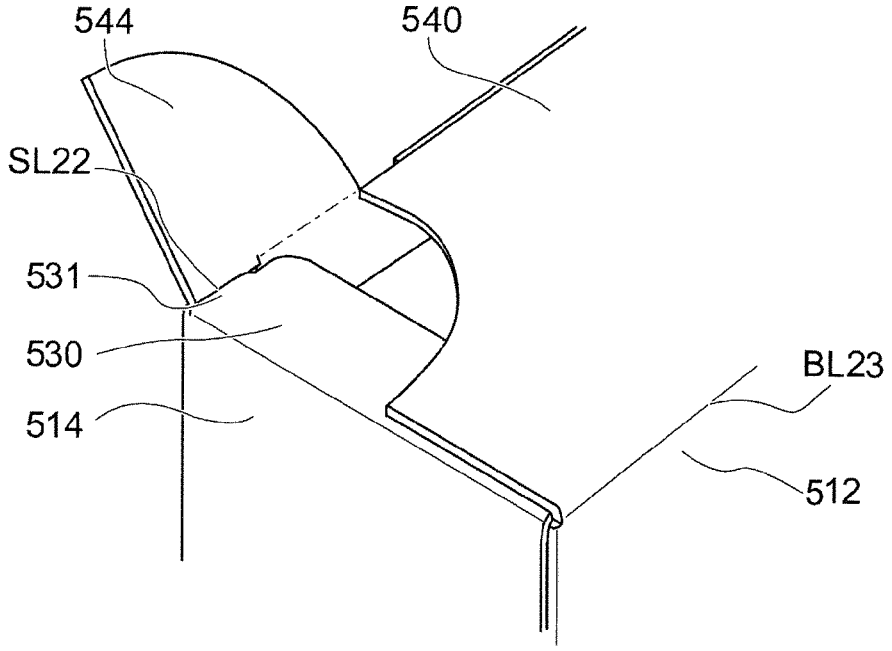
FIG. 20B is a rear perspective view illustrating the behavior of the slit lock release gripping piece of the fifth embodiment.

As illustrated in FIGS. 19A and 19B, the slit lock release gripping piece 544 is raised up from the state illustrated in FIGS. 18A and 18B due to a pulling force in upward and forward directions created by a human hand. As illustrated in FIGS. 20A and 20B, the insertion piece 550 is also pulled forward due to the pulling force created by a human hand from the state illustrated in FIGS. 19A and 19B. Then, the left slit SL22, which is the slit at a side of insertion piece 550 in a lateral direction of the insertion piece 550 where slit lock release gripping piece 544 is formed, moves forward with respect to the left slit engaging piece 531 of the left side flap 530, allowing the left slit engaging piece 531 to be taken out of the left slit SL22.

That is, the engagement between the insertion piece 550 and the left slit engaging piece 531 in the left slit SL22 is released. It is noted that, because the packing box 500 has flexibility, the front wall plate member 511 deforms in a greater or lesser degree due to a forward pulling force created by a human hand, allowing the left slit SL22 to move forward.

Figure 21A:
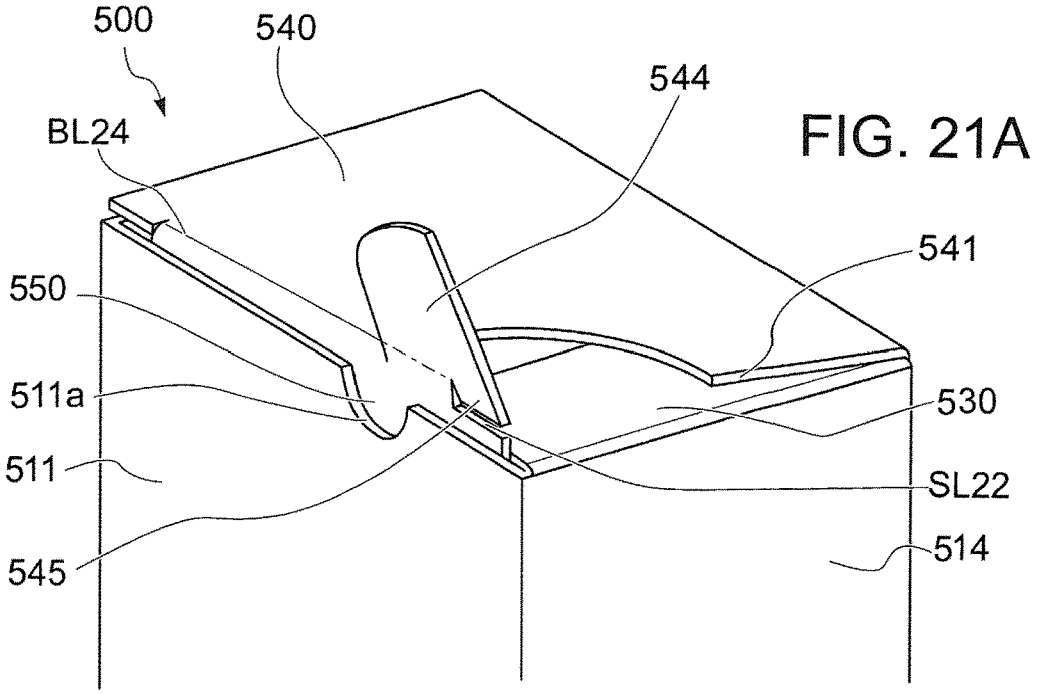
FIG. 21A is a front perspective view illustrating the behavior of the slit lock release gripping piece of the fifth embodiment.
Figure 21B:
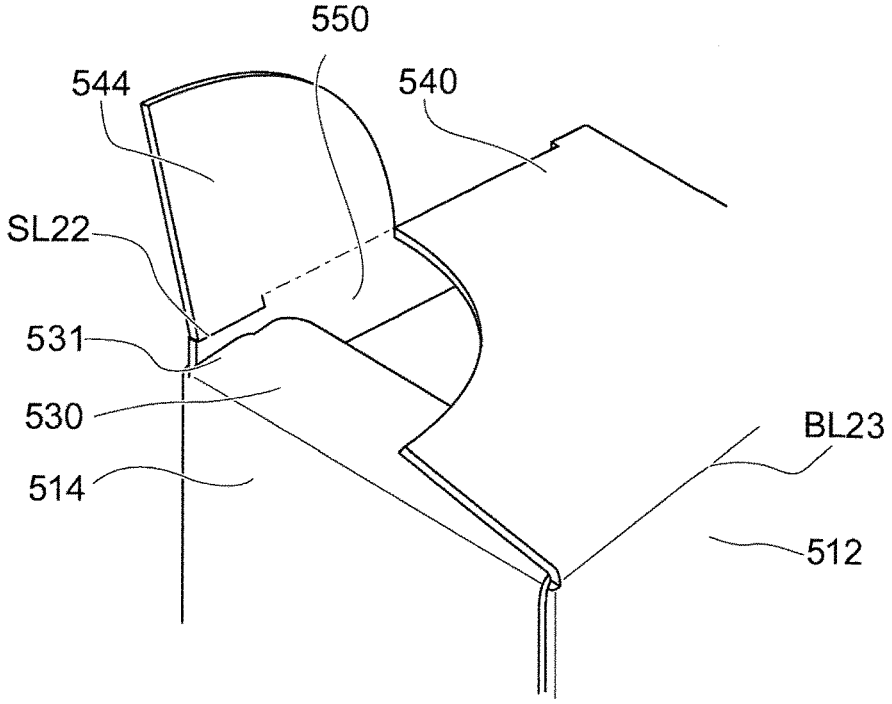
FIG. 21B is a rear perspective view illustrating the behavior of the slit lock release gripping piece of the fifth embodiment.

As illustrated in FIGS. 21A and 21B, the slit lock release gripping piece 544 is pulled upward and forward from the state illustrated in FIGS. 20A and 20B due to the pulling force in upward and forward directions created by a human hand. Then, the insertion piece 550 is also pulled upward and forward, causing the insertion piece 550 to move upward while the left slit engaging piece 531 is out of the left slit SL22.

Figure 22A:
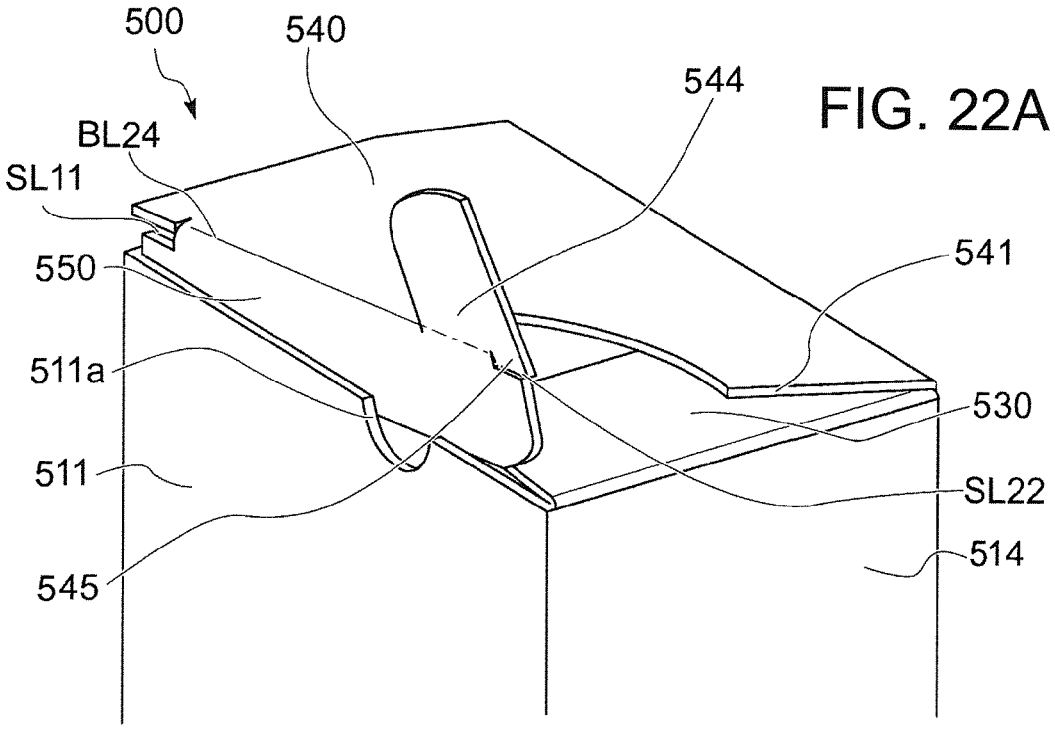
FIG. 22A is a front perspective view illustrating the behavior of the slit lock release gripping piece of the fifth embodiment.
Figure 22B:
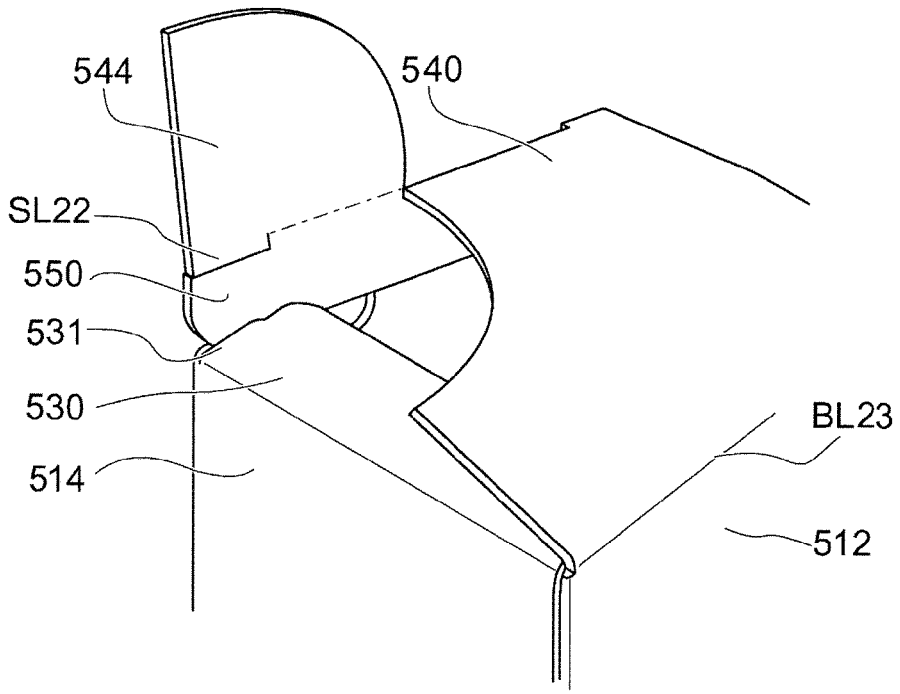
FIG. 22B is a rear perspective view illustrating the behavior of the slit lock release gripping piece of the fifth embodiment.

As illustrated in FIGS. 22A and 22B, due to the pulling force in upward and forward directions created by a human hand in the state illustrated in FIGS. 21A and 21B, the top face lid 540 starts to open while being slightly twisted such that one side of the top face lid 540 in the lateral direction thereof where the slit lock release gripping piece 544 is formed precedes the other side of the top face lid 540 in the lateral direction thereof. At this point, the insertion piece 550 is inclined with respect to the lateral direction, and the engagement between the insertion piece 550 and the right slit engaging piece 521 of the right side flap 520 in the right slit SL11 at the other side of the top face lid 540 in the lateral direction thereof is loosened.

The right slit SL11 then moves upward while being inclined with respect to the right slit engaging piece 521 of the right side flap 520, causing right slit engaging piece 521 to be taken out of the right slit SL11. That is, the engagement between the insertion piece 550 and the right slit engaging piece 521 in the right slit SL11 is released.

Next, as illustrated in FIG. 23, due to an upward pulling force created by a human hand in the state illustrated in FIGS. 22A and 22B, the insertion piece 550 is taken out of the box body 510, and the top face lid 540 becomes an open state. As described above, because the pulling force created by a human hand acts upward and forward and the direction of the pulling force does not need to be inverted, the slit lock can be released smoothly to open the top face lid 540. Also, a fancy box housed in the packing box 500 can be taken out of the packing box 500 without using a tool such as a cutter.

Furthermore, as illustrated in FIGS. 24A to 24C, the left slit SL22 of the present invention is formed with the left L-shaped cut CT22 (see FIG. 17) and the insertion piece 550 in a folded state with respect to the top face lid 540. The left L-shaped cut CT22 is formed by cutting from a start point on the top face front end edge folding ruled line BL24, which is a border between the insertion piece 550 and the top face lid 540, toward a side of the insertion piece 550 for a length that is at least equal to a thickness d1 of the left side flap 530 and then cutting toward a side end of the insertion piece 550.

Also, a part of the top face lid 540 that projects forward from the top face front end edge folding ruled line BL24, which is the border between the insertion piece 550 and the top face lid 540, due to the left L-shaped cut CT22 while the insertion piece 550 is in the folded state with respect to the top face lid 540 forms an unlock projection piece 545. The unlock projection piece 545 is configured so as to abut against the left slit engaging piece 531 in the left slit SL22 when the slit lock release gripping piece 544 is raised up to release the engagement created by the slit lock engaging structure LK.

Behavior and function of the unlock projection piece 545 will now be described. As illustrated in FIG. 24A, the left slit engaging piece 531 enters into the left slit SL22 having a size that is at least equal to the thickness d1 of the left side flap 530 to engage the insertion piece 550. Also, the unlock projection piece 545 projects forward from the top face front end edge folding ruled line BL24.

As illustrated in FIG. 24B, the slit lock release gripping piece 544, which is a part of the top face lid 540, is torn along the tear inducing line 543 from the state illustrated in FIG. 24A and gripped by a human hand. Then, due to a pulling force acting in upward and forward directions created by a human hand, the slit lock release gripping piece 544 swings upward and forward around the top face front end edge folding ruled line BL24. At this moment, the unlock projection piece 545 provided across the top face front end edge folding ruled line BL24 from the slit lock release gripping piece 544 swings downward and rearward so as to close the left slit SL22 and abuts against left slit engaging piece 531 in the left slit SL22.

The unlock projection piece 545 then pushes the left slit engaging piece 531 in the left slit SL22 rearward in a relative manner. At this moment, due to a reaction force from the left slit engaging piece 531, the top face front end edge folding ruled line BL24 and the slit lock release gripping piece 544, the insertion piece 550 and the left slit SL22 in the vicinity of the top face front end edge folding ruled line BL24 slightly moves forward and the front wall plate member 511 deflects forward.

As illustrated in FIG. 24C, when the slit lock release gripping piece 544 further swings and is raised up by a human hand from the state illustrated in FIG. 24B, the unlock projection piece 545 closes the left slit SL22. Then, the unlock projection piece 545 pushes a front end of the left slit engaging piece 531, causing the top face front end edge folding ruled line BL24 and the slit lock release gripping piece 544, the insertion piece 550, and the left slit SL22 in the vicinity of the top face front end edge folding ruled line BL24 to further move forward and the front wall plate member 511 to further deflect forward.

Accordingly, the left slit engaging piece 531 in the left slit SL22 is relatively pushed out of the left slit SL22, and the engagement between the insertion piece 550 and the left slit engaging piece 531 in the left slit SL22 is released. In other words, because the unlock projection piece 545 is provided, the engagement between the insertion piece 550 and the left slit engaging piece 531 in the left slit SL22 is released at a timing illustrated in the above-described FIGS. 19A and 19B, making it easier to open the top face lid 540.

Also, as illustrated in FIGS. 18A, 19A, 20A, and 21A, in the present embodiment a cutout portion 511*a* having an arc-like shape as one example is provided in an upper end portion of the front wall plate member 511 so as to oppose the tear inducing line 543 at the front end edge 542 of the top face lid 540. Thus, when the slit lock release gripping piece 544 is pulled upward and forward by a pulling force, a portion of the front wall plate member 511 near the slit lock release gripping piece 544 can easily deflect forward and the insertion piece 550 can be easily displaced forward. Also, when the slit lock release gripping piece 544 is pulled upward and forward by a pulling force, stress acting on an end point of the tear inducing line 543, which is a joint portion between the slit lock release gripping piece 544 and the insertion piece 550, is dispersed. That is, a break that tends to occur at this point is suppressed. The shape of the cutout portion 511*a* is not restricted to the arc-like shape: it may be a V-shape or a U-shape, for example.

Although in the present embodiment slit lock release gripping piece 544 is provided only on the left side in the lateral direction, it may be provided on the right side or even on both sides of the lateral direction.

Because the packing box 500 of the fifth embodiment of the present invention obtained as described above has a part of the top face lid 540 that can be torn along the tear inducing line 543 extending from the left flap opposing edge 541, which is a flap opposing edge of the top face lid 540, to the front end edge 542 of the top face lid 540 to form the slit lock release gripping piece 544 that can be used for releasing the engagement by the slit lock engaging structure LK by being torn along the tear inducing line 543 and raised up with respect to the top face lid 540 by a human hand, the engagement by the slit lock engaging structure LK, which is the engagement between the insertion piece 550 and the left side flap 530 in the left slit SL22 on the side in the lateral direction of the insertion piece 550 where the slit lock release gripping piece 544 is formed, can be easily released even if the interior of the box body 510 is tightly filled with a fancy box or the like.

Also, because the left slit SL22 is formed with the left L-shaped cut CT22 formed by cutting from a start point on the top face front end edge folding ruled line BL24, which is a border between the insertion piece 550 and the top face lid 540, toward a side of the insertion piece 550 for a length that is at least equal to the thickness d1 of the side flap and then cutting toward a side end of the insertion piece 550 and the insertion piece 520 folded with respect to the top face lid 540, and a part of the top face lid 540 that projects forward from the openable front top face front end edge folding ruled line BL24, which is the border between the insertion piece 550 and the top face lid 540, when the insertion piece 520 is folded with respect to the top face lid 540 forms the unlock projection piece 545 that is able to abut against the left side flap 530 in the slit when the slit lock release gripping piece 544 is raised up to release the engagement created by the slit lock engaging structure LK, the engagement by the slit lock engaging structure LK, which is the engagement between the insertion piece 550 and the left side flap 530 in the left slit SL22 on the side in the lateral direction of the insertion piece 550 where the slit lock release gripping piece 544 is formed, can be reliably released.

Also, because the tear inducing line 543 is formed in an arc-like shape that is orthogonal to the left flap opposing edge 541 and front end edge 542 of the top face lid 540, the slit lock release gripping piece 544 can be formed by tearing along the tear inducing line 543 smoothly.

Also, because the arc-like shape of the tear inducing line 543 is an arc of a precise circle whose center is located at the cross-point CP of the front end edge 542 and the left flap opposing edge 541 of the top face lid 540, the slit lock release gripping piece 544 can be formed by tearing along the tear inducing line 543 more smoothly.

Also, because the cutout portion 511*a* is provided in the upper end portion of the front wall plate member 511 so as to oppose the tear inducing line 543 at the front end edge 542 of the top face lid 540, the engagement by the slit lock engaging structure LK on the side in the lateral direction of the insertion piece 550 where the slit lock release gripping piece 544 is formed can be released more easily, and a break that tends to occur at this point can be suppressed so that the engagement between the insertion piece 550 and the left side flap 530 in the left slit SL22 created by the slit lock engaging structure LK can be more reliably released.

Sixth Embodiment

Figure 25A:
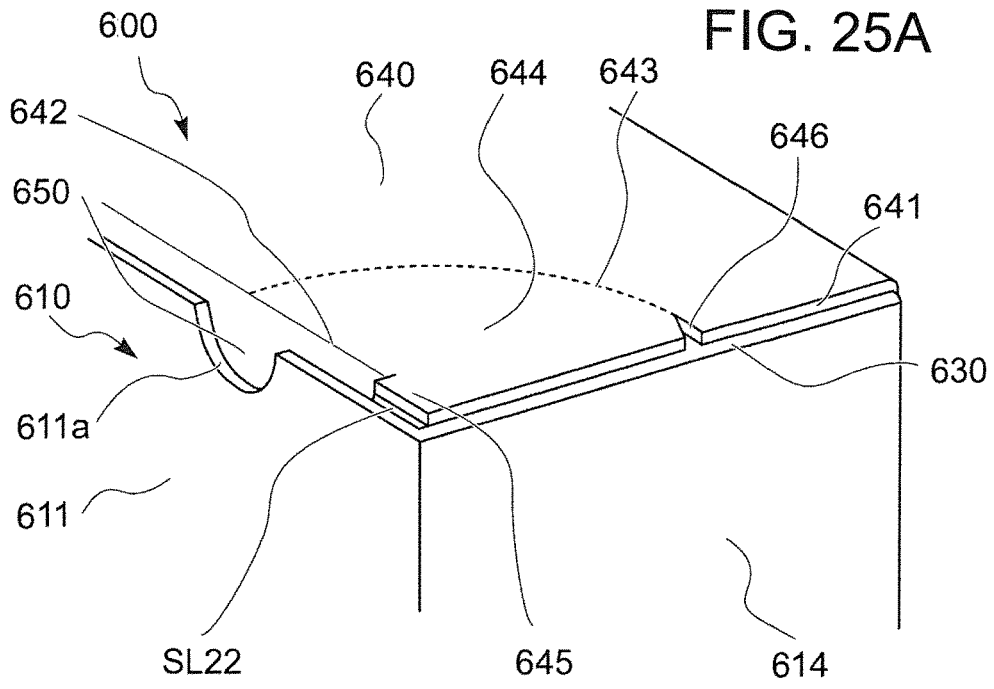
FIG. 25A is a front perspective view illustrating the packing box of a sixth embodiment.

A packing box 600 of a sixth embodiment of the present invention will now be described with reference to FIG. 25A. FIG. 25A is a front perspective view illustrating the packing box 600 of the sixth embodiment of the present invention. The packing box 600 of the sixth embodiment is a modified version of the packing box 500 of the fifth embodiment in which a flap opposing edge cutout 646 is formed at a position where the tear inducing line 543 reaches the left flap opposing edge 541 of the top face lid 540, and has many elements that are common with the packing box 500 of the fifth embodiment. Thus, the common elements will be identified with similar numbers in 600s and will not be described in detail.

As illustrated in FIG. 25A, the packing box 600 of the sixth embodiment of the present invention has the flap opposing edge cutout 646 that is formed at a position where a tear inducing line 643 reaches a left flap opposing edge 641 of a top face lid 640. This enables the flap opposing edge cutout 646 to function as a mark. As a result, a start position for tearing along the tear inducing line 643 becomes easily visible.

Also, a fingertip of a human hand can easily catch on the flap opposing edge cutout 646, making it easier to insert the fingertip between a slit lock release gripping piece 644, which is a part of the top face lid 640, and a left side flap 630. As a result, the slit lock release gripping piece 644 can be easily torn along tear inducing line 643 and raised up.

Seventh Embodiment

Figure 25B:
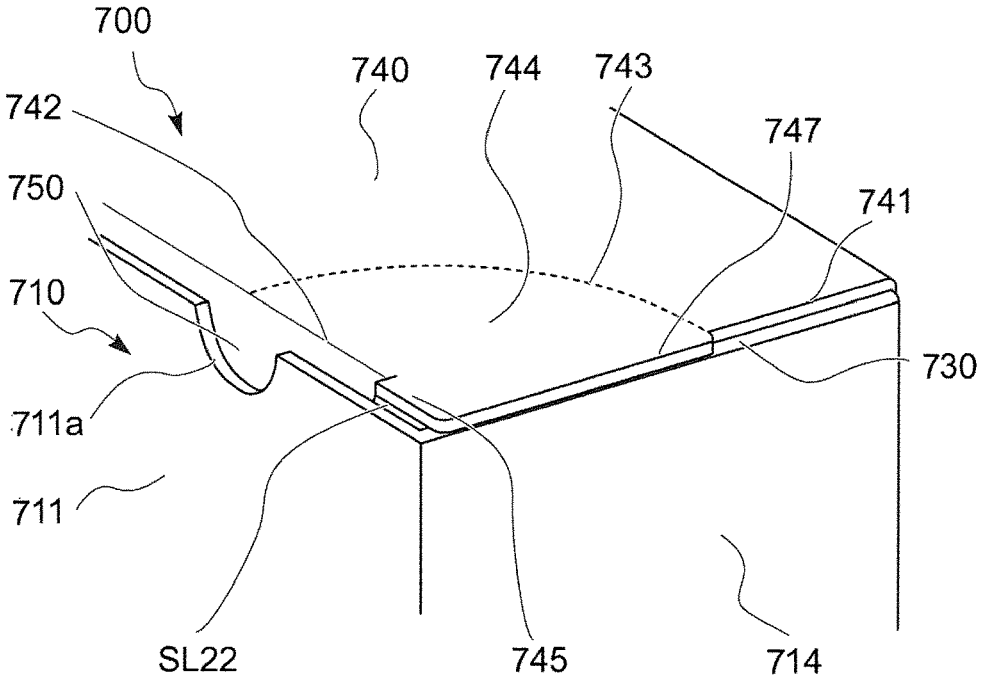
FIG. 25B is a front perspective view illustrating the packing box of a seventh embodiment.

A packing box 700 of a seventh embodiment of the present invention will now be described with reference to FIG. 25B. FIG. 25B is a front perspective view illustrating the packing box 700 of the seventh embodiment of the present invention. The packing box 700 of the seventh embodiment is a modified version of the packing box 500 of the fifth embodiment where a flap opposing edge projecting piece 747 is formed on the left flap opposing edge 541 in a portion anterior to the tear inducing line 543 on the top face lid 540, and has many elements that are common with the packing box 500 of the fifth embodiment. Thus, the common elements will be identified with similar numbers in 700s and will not be described in detail.

As illustrated in FIG. 25B, the packing box 700 of the sixth embodiment of the present invention has the flap opposing edge projecting piece 747 that is formed on a left flap opposing edge 741 in a portion anterior to a tear inducing line 743 on a top face lid 740. The flap opposing edge projecting piece 747 projects in a left side of the lateral direction. This enables the flap opposing edge projecting piece 747 to function as a mark. As a result, a start position for tearing along the tear inducing line 743 becomes easily visible.

Also, a fingertip of a human hand can easily catch on the flap opposing edge projecting piece 747, making it easier to insert the fingertip between a flap opposing edge projecting piece 747, which is a part of the top face lid 740, and a left side flap 730. As a result, the slit lock release gripping piece 744 can be easily torn along tear inducing line 743 and raised up. It will be more effective if the flap opposing edge projecting piece 747 slightly projects from a face of the left side wall plate member 714.

Eighth Embodiment

Figure 26:
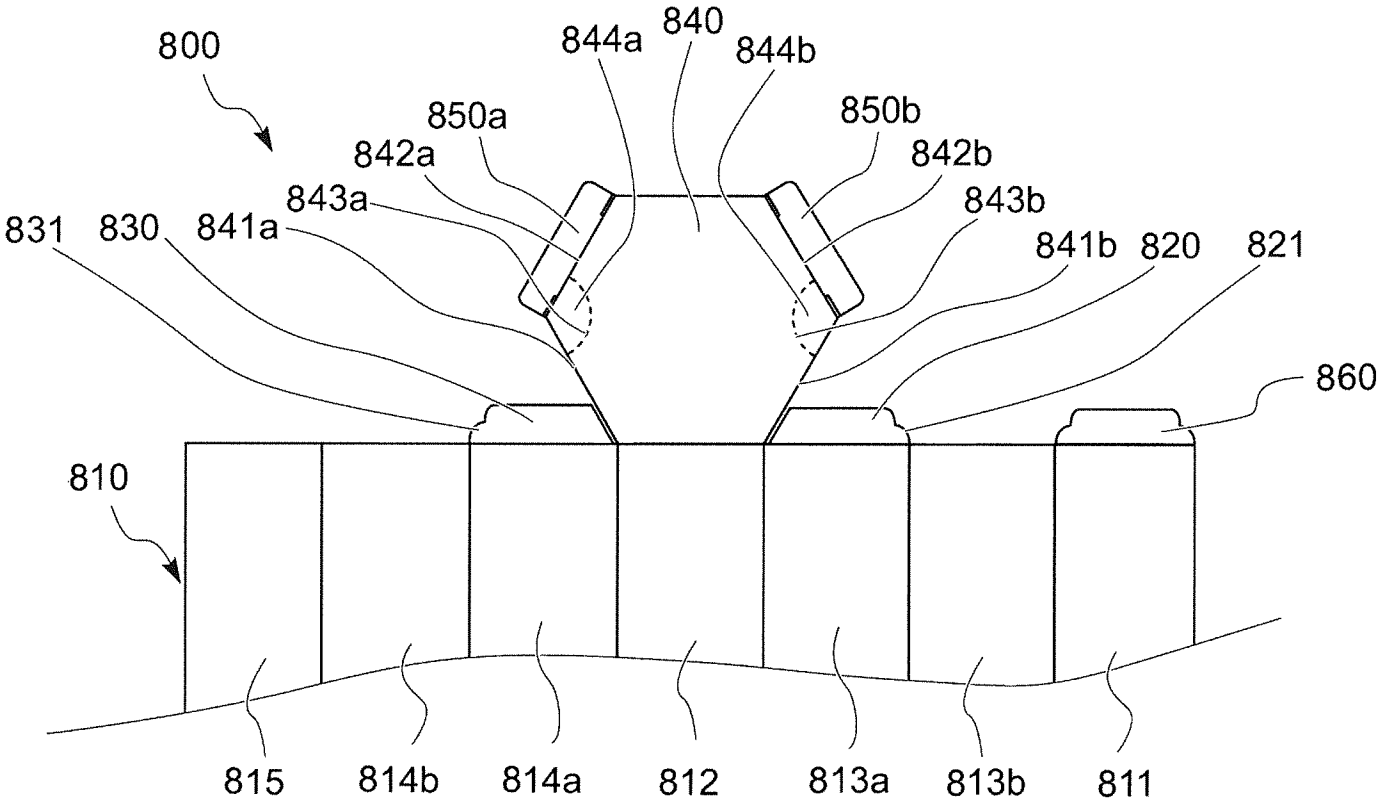
FIG. 26 is a development view of the upper portion of the packing box of an eighth embodiment of the present invention.

A packing box 800 of an eighth embodiment of the present invention will now be described with reference to FIG. 26. FIG. 26 is a development view of an upper part of the packing box of the eighth embodiment of the present invention. The packing box 800 of the eighth embodiment is a modified version of the packing box 500 of the fifth embodiment having a hexagonal-column shape, and has many elements that are common with the packing box 500 of the fifth embodiment. Thus, the common elements will be identified with similar numbers in 800s and will not be described in detail.

As illustrated in FIG. 26, the packing box 800 having a hexagonal-column shape of the eighth embodiment of the present invention includes a front wall plate member 811, a rear wall plate member 812, a right side wall plate member 813*a*, a right side wall plate member 813*b*, a left side wall plate member 814*a*, a left side wall plate member 814*b*, and a side wall margin 815. It is noted that the packing box 800 having a hexagonal-column shape can tightly house fancy boxes having a triangular-column shape or fancy boxes having a quadrangular-column shape whose cross-section as seen in a plan view is a rhombus.

The side wall margin 815 is glued to an inner face of the front wall plate member 811 with a glue, for example. The top face lid 840 has two insertion pieces 850*a*, 850*b* connected thereto. The insertion piece 850*b* is slit-locked by a right slit engaging piece 821 of a right side flap 820 connected to an upper end portion of the right side wall plate member 813*a*. Similarly, the insertion piece 850*a* is slit-locked by a left slit engaging piece 831 of a left side flap 830 connected to an upper end portion of the left side wall plate member 814*a*.

Also, each of the insertion pieces 850*a*, 850*b* is slit-locked by a part of a front flap 860 connected to an upper end portion of the front wall plate member 811. Two tear inducing lines 843*a*, 843*b* are provided. The tear inducing line 843*a* extends from a left flap opposing edge 841*a* to a left insertion piece side edge portion 842*a*, and the tear inducing line 843*b* extends from a right flap opposing edge 841*b* to a right insertion piece side edge portion 842*b*.

As with the above-described embodiments, parts of the top face lid 840 as openable lids are torn along the tear inducing lines 843*a*, 843*b* with a pulling force created by a human hand to form slit lock release gripping pieces 844*a*, 844*b*. Accordingly, the engagement by the slit lock engaging structure LK, which is the engagement between the insertion piece 850*a* and the left side flap 830 in a slit or the engagement between the insertion piece 850*b* and the right side flap 820 in a slit, can be released. The mechanism of releasing the slit lock is similar to those of the above-described embodiments and is thus not described in detail.

INDUSTRIAL APPLICABILITY

The present invention particularly relates to a packing box that packs a product itself, such as a cosmetic, drug, food, or toy, or a fancy box that houses the product and is displayed on a sales floor, such as a store front, for protecting the product or the fancy box from being damaged or impacted during delivery of the product or the fancy box to the sales floor.

REFERENCE SIGNS LIST

100, 200, 300, 400 packing box
110, 210, 310, 410 box body
111, 211A, 311A, 411A openable lid
211B, 311B, 411B (the other) openable lid
111*a*, 211Aa, 311Aa, 411Aa base end
211Ba, 311Ba, 411Ba (the other) base end
111*b*, 211Ab, 311Ab right flap opposing edge
411Ab left flap opposing edge
211Bb, 311Bb, 411Bb (the other) flap opposing edge
111*c*, 211Ac, 311Ac, 411Ac front end edge
211Bc, 311Bc, 411Bc (the other) front end edge
111*d*, 211Ad, 311Ad, 411Ad tear inducing line
211Bd, 311Bd, 411Bd (the other) tear inducing line
111*e*, 211Ae, 311Ae, 411Ae slit lock release gripping piece
211Be, 311Be, 411Be (the other) slit lock release gripping piece
111*f*, 211Af, 311Af, 411Af unlock projection piece
211Bf, 3118*f*, 411Bf (the other) unlock projection piece
112 rear wall plate member
412 rectangular plate member
113 left side wall plate member (lid side member)
114, 414 front wall plate member
115, 215, 315 right side wall plate member (lid side member)
116 right side rear margin
216, 316 margin
416A triangular margin
416B rectangular margin
317 rear left curved surface
318 rear right curved surface
419 rear right side plate member
120, 220A, 320A, 420A insertion piece
220B, 320B, 420B (the other) insertion piece
130, 230A, 330A, 430A left side flap
230B, 330B, 430B (the other) left side flap
131 left slit engaging piece
140, 240A, 340A, 440A right side flap
240B, 340B, 440B (the other) right side flap
141 right slit engaging piece
142 temporary gluing portion
BL folding line
BL1 openable base end folding ruled line (folding line)
BL2 openable front end edge folding ruled line (folding line)
BL3 left side wall upper end folding ruled line (folding line)
BL4 right side wall upper end folding ruled line (folding line)
BL5 rear wall left end folding ruled line (folding line)
BL6 left side wall front end folding ruled line (folding line)
BL7 front wall right end folding ruled line (folding line)
BL8 right side wall rear end folding ruled line (folding line)
CP cross-point (of front end edge and flap opposing edge)
CT1 left L-shaped cut
CT2 right L-shaped cut
d1 thickness of side flap
EE product taking-in/out opening
LK slit lock engaging structure
SL1 left slit
SL2 right slit
500, 600, 700, 800 packing box
510, 610, 710, 810 box body
511, 611, 711, 811 front wall plate member
511*a*, 611*a*, 711*a* cutout portion
512, 812 rear wall plate member
513, 813*a* right side wall plate member (side wall plate member)
813*b* right side wall plate member (side wall plate member)
514, 614, 714, 814*a* left side wall plate member (side wall plate member)
814*b* left side wall plate member (side wall plate member)
515 rear wall margin
815 side wall margin
516 front side bottom plate member (bottom plate member)
516*a* front side bottom base
516*b* front side bottom margin
516*c* front side bottom tongue piece
517 rear side bottom plate member (bottom plate member)
517*a* rear side bottom base
517*b* rear side bottom margin
517*c* rear side bottom tongue piece
518 right bottom plate member (bottom plate member)
519 left bottom plate member (bottom plate member)
520, 820 right side flap
521, 821 right slit engaging piece
530, 630, 730, 830 left side flap
531, 831 left slit engaging piece
540, 640, 740, 840 top face lid (openable lid)
541, 641, 741, 841*a* left flap opposing edge
841*b* right flap opposing edge
542, 642, 742, 842*a* front end edge (left insertion piece side edge portion)
842*b* front end edge (right insertion piece side edge portion)
543, 643, 743, 843*a* tear inducing line
843*b* tear inducing line
544, 644, 744, 844*a* slit lock release gripping piece
844*b* slit lock release gripping piece
545, 645, 746 unlock projection piece
646 flap opposing edge cutout
747 flap opposing edge projecting piece
550, 650, 750, 850*a* insertion piece
850*b* insertion piece
860 front flap
BL11 front wall right end folding ruled line (folding line)
BL12 rear wall right end folding ruled line (folding line)
BL13 front wall left end folding ruled line (folding line)
BL14 rear wall left end folding ruled line (folding line)
BL15 front wall lower end folding ruled line (folding line)
BL16 front side bottom folding ruled line (folding line)
BL17 rear wall lower end folding ruled line (folding line)
BL18 rear side bottom folding ruled line (folding line)
BL19 right side wall lower end folding ruled line (folding line)
BL20 left side wall lower end folding ruled line (folding line)
BL21 right side wall upper end folding ruled line (folding line)
BL22 left side wall upper end folding ruled line (folding line)
BL23 rear wall upper end folding ruled line (folding line)
BL24 top face front end edge folding ruled line (folding line)
CP cross-point (of front end edge and flap opposing edge)

CT11 right L-shaped cut
CT22 left L-shaped cut
d1 thickness of side flap
LK slit lock engaging structure
SL11 right slit
SL22 left slit

The invention claimed is:

1. A packing box comprising:

a box body having a front wall plate member, a rear wall plate member, a plurality of side wall plate members, and a bottom plate member for housing a product;

a side flap that is connected via a first folding line to an upper end portion of one of the side wall plate members for preventing protrusion of the product;

a top face lid that is connected via a second folding line to an upper end portion of the rear wall plate member for openably sealing an upper end portion of the box body; and an insertion piece that is connected to a front end edge of the top face lid via a third folding line and is inserted into the box body for holding the top face lid, the packing box including a slit lock engaging structure that maintains a state in which the top face lid is closed by engaging a slit engaging piece that is a part of the side flap into a slit created by cutting a part of a connection base end of the insertion piece along a direction parallel to the third folding line;

wherein the top face lid includes a part that can be torn along a tear inducing line extending from a side flap opposing edge of the top face lid to a front end edge of the top face lid so that the part can be held and torn along the tear inducing line by a human hand and be raised up with respect to the top face lid to form a slit lock release gripping piece that can be used for releasing engagement created by the slit lock engaging structure;

wherein the slit includes a L-shaped cut formed by a first cut extending from a start point on said third folding line, which is a border between the insertion piece and the top face lid, in a direction transverse to said third folding line, toward an edge of the insertion piece for a length that is at least equal to a thickness of the side flap, and a second cut extending in a direction parallel to said third folding line toward a side end of the insertion piece, and the insertion piece is folded with respect to the top face lid for forming the slit;

wherein the top face lid is locked in a closed condition by the engagement of said slit engagement piece with said slit;

wherein a part of the top face lid projecting forward from the third folding line when the insertion piece is folded with respect to the top face lid forms an unlock projection piece that is able to abut against the slit-engaging piece in the slit when the slit lock release gripping piece is raised up to release the engagement created by the slit lock engaging structure; and wherein said top face lid is openable by a sequence of steps, said steps consisting of tearing said part of the top face lid along said tear inducing line and raising said part up with respect to the top face lid to form said slit lock release gripping piece, manually rotating said part upward and forward about said third folding line, thereby causing said unlock projection piece to abut said slit engaging piece and disengage said slit engaging piece from said slit, and manually pulling upward on said slit lock release gripping piece to remove the insertion piece from the box body and raise the top face lid.

2. The packing box according to claim 1, wherein the tear inducing line is formed in an arc-like shape that is orthogonal to the side flap opposing edge and the front end edge of the top face lid.

3. The packing box according to claim 2, wherein at least one of said slit lock release gripping piece and said side flap has a temporary gluing portion on a face thereof opposing the other of said slit lock release gripping piece and said side flap, the temporary gluing portion including a glue applied thereto for gluing to, removing from, and regluing to the other of said slit lock release gripping piece and the side flap.

4. The packing box according to claim 1, wherein the tear inducing line is formed in an arc-like shape that is orthogonal to the side flap opposing edge and the front end edge of the top face lid, and wherein the arc-like shape of the tear inducing line is an arc of a precise circle whose center is located at a cross-point between the front end edge and the side flap opposing edge of the top face lid.

5. The packing box according to claim 1, wherein a cutout portion is provided in an upper end portion of the front wall plate member so as to oppose the tear inducing line at the front end edge of the top face lid.

6. The packing box according to claim 1, wherein the tear inducing line is formed in an arc-like shape that is orthogonal to the side flap opposing edge and the front end edge of the top face lid, and wherein a cutout portion is provided in an upper end portion of the front wall plate member so as to oppose the tear inducing line at the front end edge of the top face lid.

7. The packing box according to claim 1, wherein the tear inducing line is formed in an arc-like shape that is orthogonal to the side flap opposing edge and the front end edge of the top face lid, wherein the arc-like shape of the tear inducing line is an arc of a precise circle whose center is located at a cross-point between the front end edge and the side flap opposing edge of the top face lid, and wherein a cutout portion is provided in an upper end portion of the front wall plate member so as to oppose the tear inducing line at the front end edge of the top face lid.

* * * * *